US010194713B2

(12) United States Patent
Dimoff et al.

(10) Patent No.: US 10,194,713 B2
(45) Date of Patent: Feb. 5, 2019

(54) ARTICLE OF FOOTWEAR WITH MESH STRUCTURE

(71) Applicant: NIKE, Inc., Beaverton, OR (US)

(72) Inventors: John T. Dimoff, Portland, OR (US); Thomas J. Rushbrook, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 56 days.

(21) Appl. No.: 14/991,292

(22) Filed: Jan. 8, 2016

(65) Prior Publication Data

US 2016/0206044 A1 Jul. 21, 2016

Related U.S. Application Data

(60) Provisional application No. 62/105,426, filed on Jan. 20, 2015.

(51) Int. Cl.

| | |
|---|---|
| ***A43B 23/02*** | (2006.01) |
| ***A43B 1/04*** | (2006.01) |
| ***A43B 5/06*** | (2006.01) |
| ***A43B 13/12*** | (2006.01) |
| ***A43C 1/04*** | (2006.01) |
| ***A43C 15/10*** | (2006.01) |

(52) U.S. Cl.

CPC ..... *A43B 23/0235* (2013.01); *A43B 1/04* (2013.01); *A43B 5/06* (2013.01); *A43B 13/122* (2013.01); *A43B 23/027* (2013.01); *A43B 23/0245* (2013.01); *A43C 1/04* (2013.01); *A43C 15/10* (2013.01)

(58) Field of Classification Search

CPC ..... A43B 23/0235; A43B 23/0245; A43B 23/0265; A43B 23/0225; A43B 1/04; A43B 23/027; A43B 3/12; A43B 3/122; A43B 3/128; A43B 3/244; A43B 3/246; A43C 1/04; A43C 1/06

USPC ..... 36/88, 103, 45, 7.1 R, 7.5, 7.6, 11.5, 15, 36/7.2, 25 R; D2/914, 943, 947, 951, D2/960, 962

See application file for complete search history.

(56) References Cited

U.S. PATENT DOCUMENTS 1,027,637 A * 5/1912 Adamson ..... A43C 15/06 168/1
1,877,080 A * 9/1932 Teshima ..... D04B 1/22 36/7.5

(Continued)

FOREIGN PATENT DOCUMENTS

CN 201971987 U 9/2011
CN 202525230 U 11/2012

(Continued)

OTHER PUBLICATIONS

International Search Report and Written Opinion dated Jun. 30, 2016 for International Patent Application No. PCT/US2016/012660.

(Continued)

*Primary Examiner* — Jameson Collier
*Assistant Examiner* — Heather Mangine
(74) *Attorney, Agent, or Firm* — Klarquist Sparkman, LLP

(57) ABSTRACT

An article of footwear includes a mesh structure. The mesh structure can be formed from a plurality of cords that are arranged in a mesh pattern or can be formed using a knitting process. The mesh structure can be disposed over the upper and the sole structure.

19 Claims, 21 Drawing Sheets

(56) References Cited

U.S. PATENT DOCUMENTS 2,022,967 A 4/1934 MacDonald
2,016,903 A * 10/1935 Miller ..... A43B 13/16 36/169
2,126,094 A * 8/1938 Daniels ..... A43B 3/122 36/11.5
2,491,297 A * 12/1949 Brown ..... A43B 3/122 36/101
2,526,940 A * 10/1950 Fello ..... A43B 3/122 36/11.5
2,862,311 A * 12/1958 Ellis ..... A43B 1/14 36/11.5
4,213,256 A * 7/1980 Mas ..... A43B 3/0084 36/124
4,300,294 A * 11/1981 Riecken ..... A43B 7/26 36/101
4,592,154 A * 6/1986 Oatman ..... A43B 5/00 36/114
4,756,098 A * 7/1988 Boggia ..... A43B 5/00 36/114
4,811,503 A * 3/1989 Iwama ..... A43B 5/0447 36/118.1
5,291,671 A * 3/1994 Caberlotto ..... A43B 5/00 36/114
5,315,768 A * 5/1994 Pacheco ..... A43B 3/16 36/134
5,692,319 A * 12/1997 Parker ..... A43B 7/1495 36/114
5,694,706 A * 12/1997 Penka ..... A43B 5/00 36/103
5,921,005 A * 7/1999 Bell ..... A43C 15/02 36/11.5
6,052,921 A * 4/2000 Oreck ..... A43C 1/00 36/50.1
6,286,233 B1 * 9/2001 Gaither ..... A43C 1/00 36/50.1
6,298,582 B1 * 10/2001 Friton ..... A43B 5/06 36/102
6,401,364 B1 * 6/2002 Burt ..... A43B 1/00 36/3 A
6,772,541 B1 * 8/2004 Ritter ..... A43B 7/14 36/50.1
6,857,204 B1 * 2/2005 Davis ..... A41B 7/02 24/442
6,922,917 B2 * 8/2005 Kerns ..... A43B 5/14 36/50.1
7,168,190 B1 * 1/2007 Gillespie ..... A43B 3/24 36/102
7,204,042 B2 * 4/2007 Aveni ..... A43B 7/08 36/45
7,370,440 B1 5/2008 Cole, III
7,568,298 B2 8/2009 Kerns
7,574,818 B2 * 8/2009 Meschter ..... A43B 7/14 36/45
7,774,884 B2 * 8/2010 Greene ..... A43B 9/00 12/142 V
7,793,435 B1 * 9/2010 Ruth ..... A43C 11/00 36/50.1
8,065,818 B2 11/2011 Greene et al.
8,151,490 B2 * 4/2012 Sokolowski ..... A43B 5/12 36/50.1
8,171,653 B1 * 5/2012 Pennington ..... A41D 17/005 36/1.5
8,312,646 B2 * 11/2012 Meschter ..... A43B 3/26 36/45
9,060,567 B2 * 6/2015 Elder ..... A43B 13/127
9,491,983 B2 * 11/2016 Rushbrook ..... A43B 13/141
9,675,130 B2 * 6/2017 Ueda ..... A43B 1/14
9,775,406 B2 * 10/2017 Connell ..... A43B 23/0265
9,907,361 B2 * 3/2018 Rushbrook ..... A43C 11/002
2003/0074806 A1 * 4/2003 Urie ..... A43B 3/126 36/11.5
2004/0181972 A1 * 9/2004 Csorba ..... A43B 7/1495 36/50.1
2004/0226190 A1 * 11/2004 Elkington ..... A43B 5/0401 36/50.5
2005/0076538 A1 * 4/2005 Sapp ..... A43B 3/18 36/72 R
2005/0172515 A1 * 8/2005 Ungari ..... A43B 1/0054 36/88
2005/0284000 A1 * 12/2005 Kerns ..... A43B 1/04 36/45
2006/0048413 A1 * 3/2006 Sokolowski ..... A43B 23/0235 36/45
2007/0011910 A1 * 1/2007 Keen ..... A43B 3/22 36/50.1
2007/0068040 A1 * 3/2007 Farys ..... A43C 1/04 36/50.1
2007/0180730 A1 * 8/2007 Greene ..... A43B 9/00 36/3 A
2008/0040947 A1 * 2/2008 Burgess ..... A43B 5/0419 36/7.6
2008/0189987 A1 * 8/2008 Geisser ..... A43C 15/09 36/114
2008/0216355 A1 * 9/2008 Becker ..... A43B 13/026 36/102
2008/0244928 A1 * 10/2008 Romboli ..... A43C 11/1493 36/50.1
2008/0289214 A1 * 11/2008 Aveni ..... A43B 3/06 36/11.5
2009/0071041 A1 * 3/2009 Hooper ..... A43B 7/06 36/3 A
2009/0229144 A1 * 9/2009 Sussman ..... A43B 3/24 36/97
2010/0024251 A1 * 2/2010 Delgatty ..... A43B 1/0027 36/101
2011/0035963 A1 * 2/2011 Baker ..... A43B 1/0018 36/114
2011/0126428 A1 * 6/2011 Hazenberg ..... A43B 13/122 36/103
2011/0131836 A1 6/2011 McKay
2011/0225843 A1 * 9/2011 Kerns ..... A43B 3/0052 36/50.1
2011/0258876 A1 * 10/2011 Baker ..... A43C 11/008 36/50.1
2011/0308115 A1 * 12/2011 Le ..... A43B 7/1495 36/9 R
2012/0180339 A1 * 7/2012 Izquieta Anaut ..... A43B 13/141 36/102
2012/0210600 A1 * 8/2012 Joubert ..... A43C 15/10 36/7.1 R
2012/0233882 A1 * 9/2012 Huffa ..... A43B 1/04 36/45
2012/0240428 A1 * 9/2012 Knoll ..... A43B 5/0427 36/50.1
2012/0297643 A1 * 11/2012 Shaffer ..... A43B 1/0027 36/83
2013/0008053 A1 * 1/2013 Nishiwaki ..... A43B 23/0255 36/102
2013/0019500 A1 * 1/2013 Greene ..... A43B 23/025 36/50.1
2013/0055590 A1 * 3/2013 Mokos ..... A43B 1/04 36/45
2013/0219750 A1 * 8/2013 Dojan ..... A43B 23/0265 36/87
2014/0130372 A1 * 5/2014 Aveni ..... A43B 3/122 36/83
2014/0223779 A1 * 8/2014 Elder ..... A43C 1/04 36/103
2014/0230286 A1 * 8/2014 Paugh ..... A43B 3/242 36/25 R
2014/0310986 A1 * 10/2014 Tamm ..... A43B 1/00 36/84
2015/0013193 A1 * 1/2015 Krueger ..... A43B 23/0265 36/114
2015/0089839 A1 * 4/2015 James ..... A43B 11/00 36/102

(56) References Cited

U.S. PATENT DOCUMENTS

| | | | | |
|---|---|---|---|---|
| 2015/0272274 | A1* | 10/2015 | Berns | A43B 23/0205 36/84 |
| 2015/0289595 | A1* | 10/2015 | Rushbrook | A43C 11/22 36/50.1 |
| 2015/0342297 | A1* | 12/2015 | Garza, Jr. | A43B 13/14 482/122 |
| 2016/0128424 | A1* | 5/2016 | Connell | A43B 23/0265 36/103 |
| 2016/0174660 | A1* | 6/2016 | Iuchi | A43B 1/04 36/45 |
| 2016/0192741 | A1* | 7/2016 | Mark | A43B 17/003 36/43 |
| 2016/0302524 | A1* | 10/2016 | Smith | A43B 13/12 |
| 2016/0366980 | A1* | 12/2016 | Bell | A43C 1/04 |
| 2017/0020231 | A1* | 1/2017 | Hausmann | A43B 3/12 |

FOREIGN PATENT DOCUMENTS

| | | | |
|---|---|---|---|
| DE | 1654669 | U | 4/1953 |
| DE | 1715241 | U | 1/1956 |
| FR | 2608386 | A3 | 6/1988 |
| JP | S49105346 | U | 9/1974 |
| WO | 9522917 | A1 | 8/1995 |
| WO | 9843506 | A1 | 10/1998 |
| WO | 2011055046 | A1 | 5/2011 |
| WO | 2016118337 | A1 | 7/2016 |

OTHER PUBLICATIONS

Partial International Search dated Mar. 29, 2016 in PCT/US2016/012660.

* cited by examiner

ARTICLE OF FOOTWEAR WITH MESH STRUCTURE

CROSS-REFERENCE TO RELATED APPLICATIONS

This application claims priority to U.S. Provisional Patent Application 62/105,426, filed Jan. 20, 2015, and titled "Article of Footwear with Mesh Structure", the entirety of which is herein incorporated by reference.

BACKGROUND

The present embodiments relate generally to articles of footwear, and in particular to articles of footwear with supporting structures.

Articles of footwear generally include two primary elements: an upper and a sole structure. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
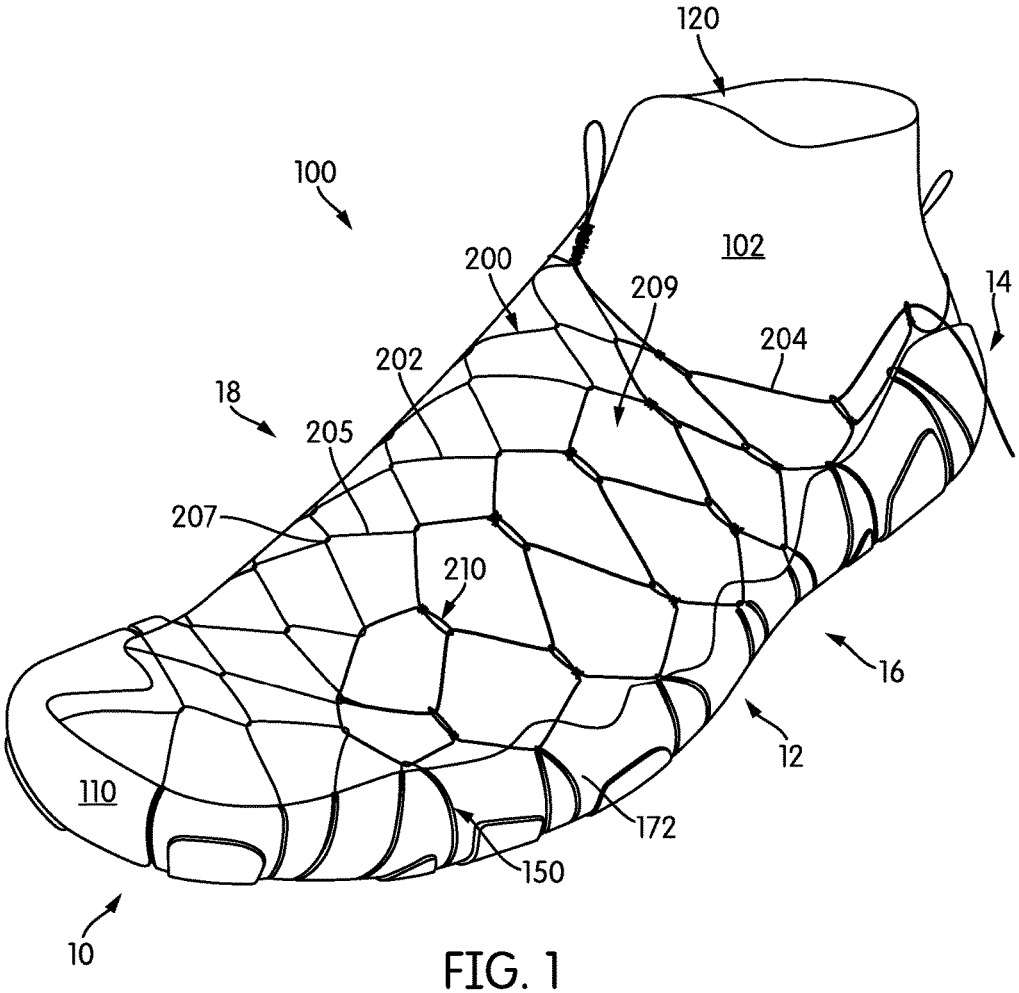
FIG. 1 is a schematic isometric lateral view of an embodiment of an article of footwear including a mesh structure.

FIG. 1 is a schematic view of an embodiment of article of footwear 100. Although a single article is shown in the embodiments for purposes of clarity, embodiments may include a corresponding first article of footwear 100 and second article of footwear (not shown), configured for a left and right foot, respectively. Thus, it will be understood that the principles discussed herein may equally apply to another article of footwear corresponding to article of footwear 100.

In one aspect, an article of footwear includes an upper with an upper interior surface and an upper exterior surface, where the upper interior surface is disposed closer to an interior cavity of the upper than the upper exterior surface. The article includes a sole structure with a sole interior surface and a sole exterior surface. The article also includes a mesh structure comprised of a plurality of cords, where the mesh structure is wrapped around the article of footwear. A portion of the mesh structure is in contact with a portion of the upper exterior surface and portion of the mesh structure is in contact with the sole exterior surface.

In another aspect, an article of footwear includes an upper with an upper interior surface and an upper exterior surface, where the upper interior surface is disposed closer to an interior cavity of the upper than the upper exterior surface. The article includes a mesh structure comprised of a plurality of cords, where the mesh structure is disposed over the upper exterior surface. The mesh structure has a mesh periphery further including a first mesh periphery portion and a second mesh periphery portion. The first mesh periphery portion and the second mesh periphery portion are separated by a gap. A fastening cord engages the first mesh periphery portion and the second mesh periphery portion such that when an end portion of the fastening cord is pulled the fastening cord pulls the first mesh periphery portion closer to the second mesh periphery portion in order to tighten the mesh structure against the upper. At least one cord in the plurality of cords comprising the mesh structure has a first cord diameter and a first cord tensile strength. The fastening cord has a second cord diameter and a second cord tensile strength. The first cord diameter is substantially equal to the second cord diameter and where the first cord tensile strength is substantially equal to the second cord tensile strength.

In another aspect, an article of footwear includes an upper with an upper interior surface and an upper exterior surface, where the upper interior surface is disposed closer to an interior cavity of the upper than the upper exterior surface. The article further includes a sole structure and a knit mesh structure comprised of a plurality of knitted segments with a mesh configuration. The knit mesh structure has a first portion, a second portion and a third portion. The second portion is disposed between the first portion and the third portion. The first portion is disposed over an instep portion of the upper on the upper exterior surface. The second portion is disposed around a toe portion of the upper on the upper exterior surface. The third portion is disposed between the upper and the sole structure. The first portion is separated from the third portion by a gap on a side portion of the upper.

In another aspect, a method of making an article of footwear having an upper and a sole structure includes flat knitting a knit mesh structure, stretching a first portion of the knit mesh structure over a top portion of the upper, stretching a second portion of the knit mesh structure around a toe portion of the upper and stretching a third portion of the knit mesh structure over a bottom portion of the upper. The method also includes assembling the sole structure with the bottom portion of the upper such that the third portion of the knit mesh structure is disposed between the upper and the sole structure.

In another embodiment, an article of footwear includes an upper having an upper interior surface and an upper exterior surface, the upper interior surface being disposed closer to an interior cavity of the upper than the upper exterior surface. The article further includes a mesh structure comprised of a plurality of cords, where the mesh structure is wrapped around the article of footwear. The article includes a plurality of channels disposed on the upper exterior surface. A portion of the mesh structure is in contact with a portion of the upper exterior surface. At least some cords in the plurality of cords are disposed through channels in the plurality of channels.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

Article of footwear 100, also referred to simply as article 100, may be configured as various kinds of footwear including, but not limited to: hiking boots, soccer shoes, football shoes, sneakers, running shoes, cross-training shoes, rugby shoes, basketball shoes, baseball shoes as well as other kinds of shoes. Moreover, in some embodiments article 100 may be configured as various other kinds of non-sports related footwear, including, but not limited to: slippers, sandals, high heeled footwear, and loafers.

Referring to FIG. 1, for purposes of reference, article 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, article 100 may include lateral side 16 and medial side 18 (see also FIG. 3). In particular, lateral side 16 and medial side 18 may be opposing sides of article 100. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of article 100. Likewise, lateral side 16 and medial side 18 are intended to represent generally two sides of an article, rather than precisely demarcating article 100 into two halves. Moreover, throughout the embodiments, forefoot portion 10, midfoot portion 12, heel portion 14, lateral side 16 and medial side 18 may be used to refer to portions/sides of individual components of article 100.

For consistency and convenience, directional adjectives are employed throughout this detailed description corresponding to the illustrated embodiments. The term "longitudinal" as used throughout this detailed description and in the claims refers to a direction extending a length of a component (e.g., article of footwear 100). In some cases, the longitudinal direction may extend from a forefoot portion to a heel portion of the component. Also, the term "lateral" as used throughout this detailed description and in the claims refers to a direction extending along a width of a component. In other words, the lateral direction may extend between a medial side and a lateral side of a component. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. In addition, the term "proximal" refers to a portion of a footwear component that is closer to a portion of a foot when an article of footwear is worn. Likewise, the term "distal" refers to a portion of a footwear component that is further from a portion of a foot when an article of footwear is worn. This detailed description makes use of these directional adjectives in describing a sole structure and a mesh structure of an article of footwear.

Article 100 may include an upper 102 as well as a sole structure 110. Generally, upper 102 may be any type of upper. In particular, upper 102 may have any design, shape, size and/or color. For example, in embodiments where article 100 is a basketball shoe, upper 102 could be a high top upper that is shaped to provide high support on an ankle.

In embodiments where article 100 is a running shoe, upper 102 could be a low top upper.

Figure 2:
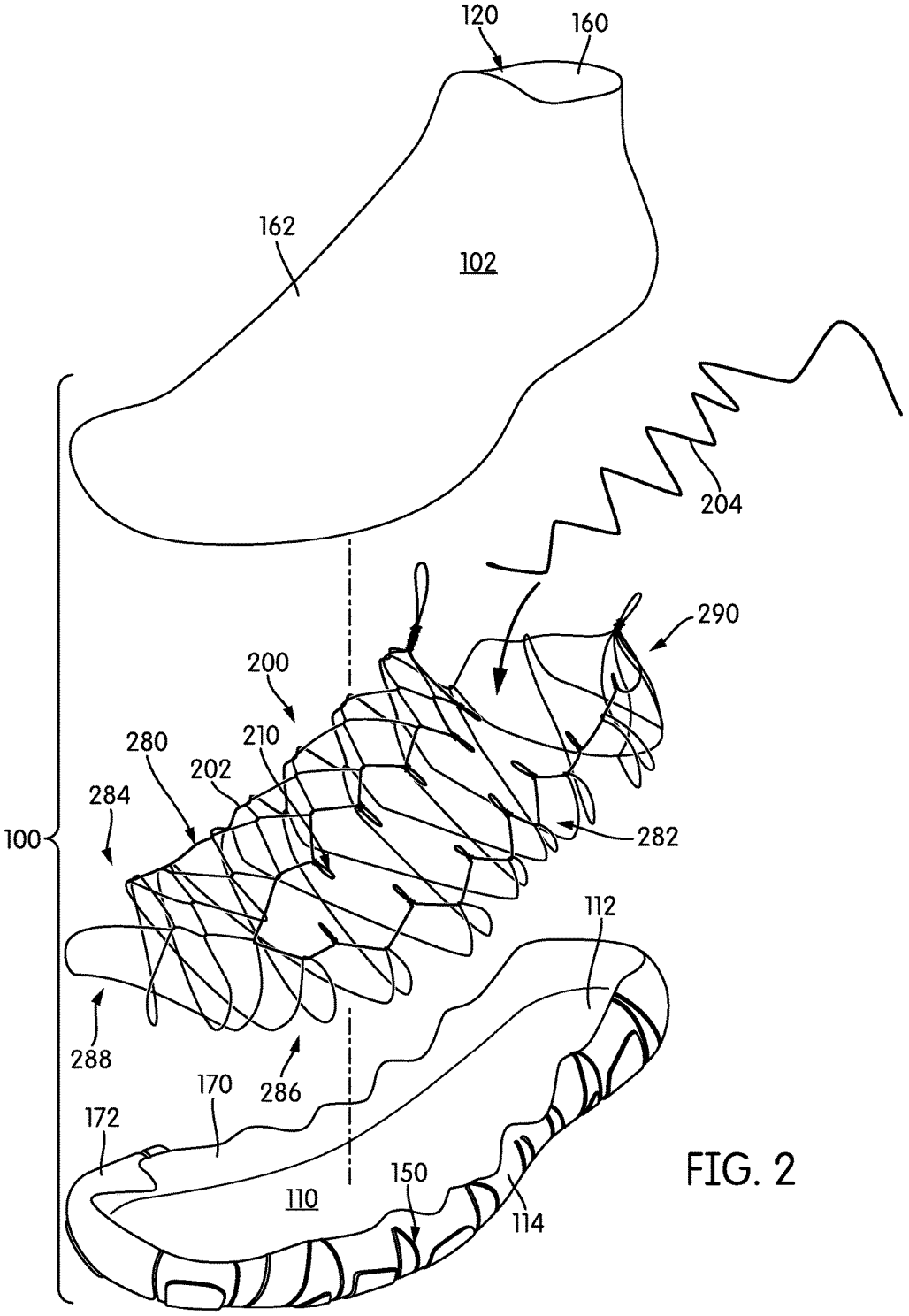
FIG. 2 is a schematic exploded isometric view of an embodiment of an article of footwear with a mesh structure.

For purposes of illustration, only some components of upper 102 are shown and described. For example, upper 102 includes opening 120 that provides entry for the foot into an interior cavity of upper 102. In some embodiments, upper 102 may take the form of a bootie, as best illustrated in FIG. 2. In some embodiments, upper 102 may cover all portions of a foot, including the top portion, side portions and bottom portion of the foot. Moreover, in some cases, in this particular bootie-like configuration, upper 102 may not incorporate fastening provisions directly, such as a lacing gap, tongue, eyelets, etc. Instead, in some cases, provisions for fastening the article may be provided separately from upper 102. In still other embodiments, of course, upper 102 may take the form of a conventional upper having, for example, a tongue, eyelets for receiving a lace as well as possibly other provisions.

Embodiments may utilize uppers comprised of any materials. Exemplary materials that could be used include, but are not limited to: leather (including natural and/or synthetic leather), knitted materials, woven materials, woven fabrics, non-woven fabrics, as well as other materials known in the art for use in uppers and articles of footwear more broadly.

In some embodiments, sole structure 110 may be configured to provide traction for article 100. In addition to providing traction, sole structure 110 may attenuate ground reaction forces when compressed between the foot and the ground during walking, running or other ambulatory activities. The configuration of sole structure 110 may vary significantly in different embodiments to include a variety of conventional or non-conventional structures. In some cases, the configuration of sole structure 110 can be configured according to one or more types of ground surfaces on which sole structure 110 may be used. Examples of ground surfaces include, but are not limited to: natural turf, synthetic turf, dirt, as well as other surfaces.

Sole structure 110 is secured to upper 102 and extends between the foot and the ground when article 100 is worn. In different embodiments, sole structure 110 may include different components. For example, sole structure 110 may include an outsole, a midsole, and/or an insole. For purposes of illustration, sole structure 110 is shown in the figures (see FIG. 2) as comprising only an outer sole member. However, other embodiments could include additional midsole and/or insole provisions.

FIG. 2 illustrates an exploded isometric view of an embodiment of article 100. Referring to FIG. 2, upper 102 and sole structure 110 may be characterized as having various portions. For example, upper 102 is seen to have an upper interior surface 160 and an upper exterior surface 162. Upper interior surface 160 may be disposed closer to the interior cavity of upper 102 than upper exterior surface 162. In other words, upper interior surface 160 may be disposed proximally to upper exterior surface 162 and may be closer to a foot than upper exterior surface 162 when article 100 is worn.

In addition, sole structure 110 is seen to have a sole interior surface 170 and a sole exterior surface 172. Sole interior surface 170 may be disposed proximally to sole exterior surface 172, i.e., sole interior surface 170 may be closer to a foot when the foot is inserted within article 100. In some embodiments, sole interior surface 170 may be in contact with a portion of upper exterior surface 162 of upper 102. In other embodiments, however, sole interior surface 170 may not contact upper 102 directly.

In some embodiments, sole structure 110 may also cover both the bottom as well as some portions of the sides of an article. As best seen in FIG. 2, sole structure 110 may comprise a bottom portion 112 and a side wall portion 114. Bottom portion 112 may be disposed between upper 102 (or a foot) and a ground surface. In contrast, side wall portion 114 may be disposed on lateral side 16 and medial side 18 of article 100.

Embodiments can include provisions for supporting a foot within an article. In some embodiments, an article may include an external support structure that provides support over a majority of a foot. In some embodiments, the external support structure may be a mesh-like or net-like structure of tensioning elements that wrap around some portions of the article to improve support for the foot.

Referring to FIGS. 1 and 2, article 100 may include a plurality of cords 202 arranged around portions of article 100. The term "cord" as used herein refers to any element having a substantial length and relatively small cross-section. A cord may monolithic in structure, for example a metal or plastic wire, or could be formed from various plies, filaments, fibers or strands of material that are twisted or otherwise joined to form the cord. Fibers have a relatively short length and require spinning or twisting processes to produce a yarn of suitable length for use in textiles. Common examples of fibers are cotton and wool. Filaments, however, have an indefinite length and may merely be combined with other filaments to produce a yarn suitable for use in textiles. Modern filaments include a plurality of synthetic materials such as rayon, nylon, polyester, and polyacrylic, with silk being the primary, naturally-occurring exception.

In some embodiments, a cord could be formed from yarns. A yarn may be formed of a single filament, which is conventionally referred to as a monofilament yarn, or a plurality of individual filaments grouped together. Yarn may also include separate filaments formed of different materials, or the yarn may include filaments that are each formed of two or more different materials. Similar concepts also apply to yarns formed from fibers. Accordingly, yarns may have a variety of configurations that generally conform to the definition provided above.

It will be understood that a "cord" is only one possible example of an elongated tensile element that could be used to form a mesh structure. In other embodiments, therefore, the cords discussed herein could be interchanged with any of the following: lines, wires, strings, twine, rope as well as possibly other tensile elements that provide tensile strength while remaining substantially flexible.

Referring now to FIG. 1, plurality of cords 202 are assembled or arranged in a mesh configuration. Thus, plurality of cords 202 are seen to together comprise a mesh structure 200. Specifically, plurality of cords 202 are comprised of various cord segments 205, which interact at intersections 207. Alternatively, such a configuration of cords could be characterized, and referred to, as a net structure.

To form mesh structure 200, plurality of cords 202 may cross-over and/or be engaged with one another at various intersections of two cords (or at intersections between two portions of the same cord). Mesh structure 200 may therefore comprise various crossings, braids, twists and/or knots between intersecting cord segments. In some embodiments, cord segments may simply be crossed, intertwined or looped around one another at an intersection. In other embodiments, cord segments could be braided together at an intersection. In still other embodiments, cord segments could be knitted together at an intersection. In at least some embodiments, mesh structure 200 may comprise a variety of intersection types such that some cord segments are simply crossed over one another, while other cord segments could be braided and/or knotted together. Still other embodiments could include provisions for threading one cord through another cord at an intersection of the two cords.

The manner in which two cord segments interact at an intersection may be selected to achieve desired behavior for mesh structure 200. In embodiments where it is desirable to maintain fixed intersections between two cord segments, a braid or knot could be used to prevent the cord segments from moving relative to one another. In embodiments where it is desirable for cord segments to adjust relative to one another, the cord segments may be simply twisted or looped around each other to partially constrain their relative configurations while allowing for some relative movement.

The arrangement of mesh structure 200 provides a wide mesh spacing between various cord segments 205. For example, mesh structure 200 is seen to comprise a plurality of spaces 209, which are bordered by various cord segments 205. In one exemplary embodiment, a typical dimension for a space in plurality of spaces 209 could vary approximately in the range between 1 to 20 percent of the longest dimension of article 100 (e.g., the length of article 100). In still other embodiments, of course, the typical dimension of the spaces could be greater than 20 percent of the longest dimension of article 100. As one particular example, in a situation where an article is a U.S. men's size 11 shoe, having a length of approximately 11 inches, a space in plurality of spaces 209 could range in between one tenth of an inch to three inches. Of course, any other sizes are possible for mesh spacing. Moreover, the absolute mesh spacing (e.g., the spacing in inches, centimeters, etc.) may vary according to the size of the corresponding article of footwear.

Referring now to FIG. 2, mesh structure 200 has a three-dimensional geometry configured to encompass the top, bottom and side portions of a foot. For example, mesh structure 200 can include a top portion 280 that may be associated with a top of a foot, a first side portion 282 that may be associated with a side of a foot, a second side portion 284 that may be associated with an opposing side of a foot and a bottom portion 286 that may be associated with the bottom of a foot. Moreover, mesh structure 200 can also have a front portion 288 associated with the front and toes of a foot as well as a rear portion 290 associated with a heel of the foot. Specifically, mesh structure 200 includes at least some cords from plurality of cords 202 that extend through each of top portion 280, first side portion 282, second side portion 284, bottom portion 286, front portion 288 and rear portion 290. This configuration may allow mesh structure 200 to completely wrap around an article and provide support to all portions of a foot inside the article.

As shown in FIG. 2, article 100 further comprises a fastening cord 204. Fastening cord 204 may be assembled with mesh structure 200 and may facilitate the tightening of mesh structure 200 around upper 102 and/or sole structure 110, as discussed in further detail below.

Figure 3:
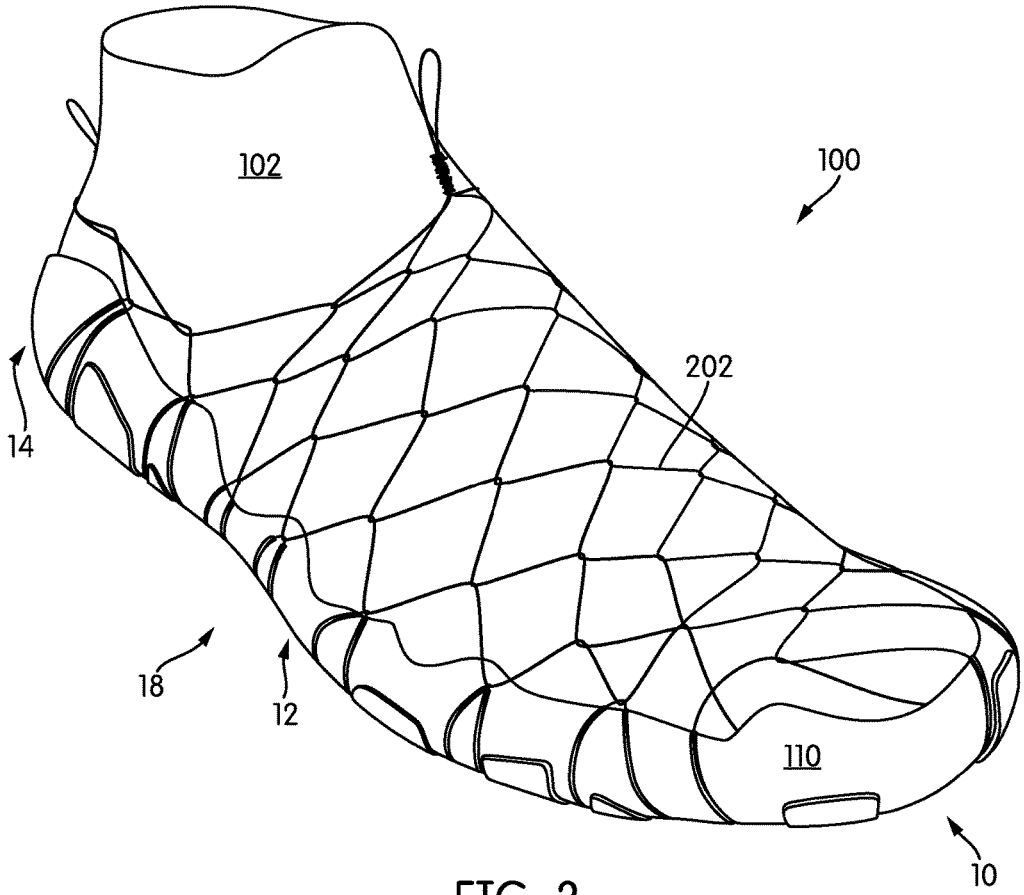
FIG. 3 is a schematic isometric medial view of an embodiment of an article of footwear including a mesh structure.

As seen in FIGS. 1-3, mesh structure 200 is configured to wrap around both upper 102 and sole structure 110. In particular, at least one portion of mesh structure 200 is in contact with upper exterior surface 162 of upper 102. Specifically, in some cases, top portion 280, first side portion 282, second side portion 284, some of front portion 288 and some of rear portion 290 may be in contact with upper exterior surface 162 of upper 102. Moreover, at least one portion of mesh structure 200 may be in contact with sole exterior surface 172 of sole structure 110. Specifically, in some cases, some of first side portion 282, some of second side portion 284, some of front portion 288, some of rear portion 290 and all of bottom portion 286 may be in contact with sole exterior surface 172. Thus, mesh structure 200 may be seen to extend around a substantial majority of article 100, including the exposed exterior portions of upper 102 and sole structure 110.

Embodiments can include provisions for tightening or fastening a mesh structure around an upper and/or sole structure. Embodiments may include a fastening system that includes a fastening cord and provisions on the mesh structure for receiving the fastening cord. Further, the mesh structure may comprise a region that may be opened and closed (or expanded and contracted) using the fastening cord.

Figure 4:
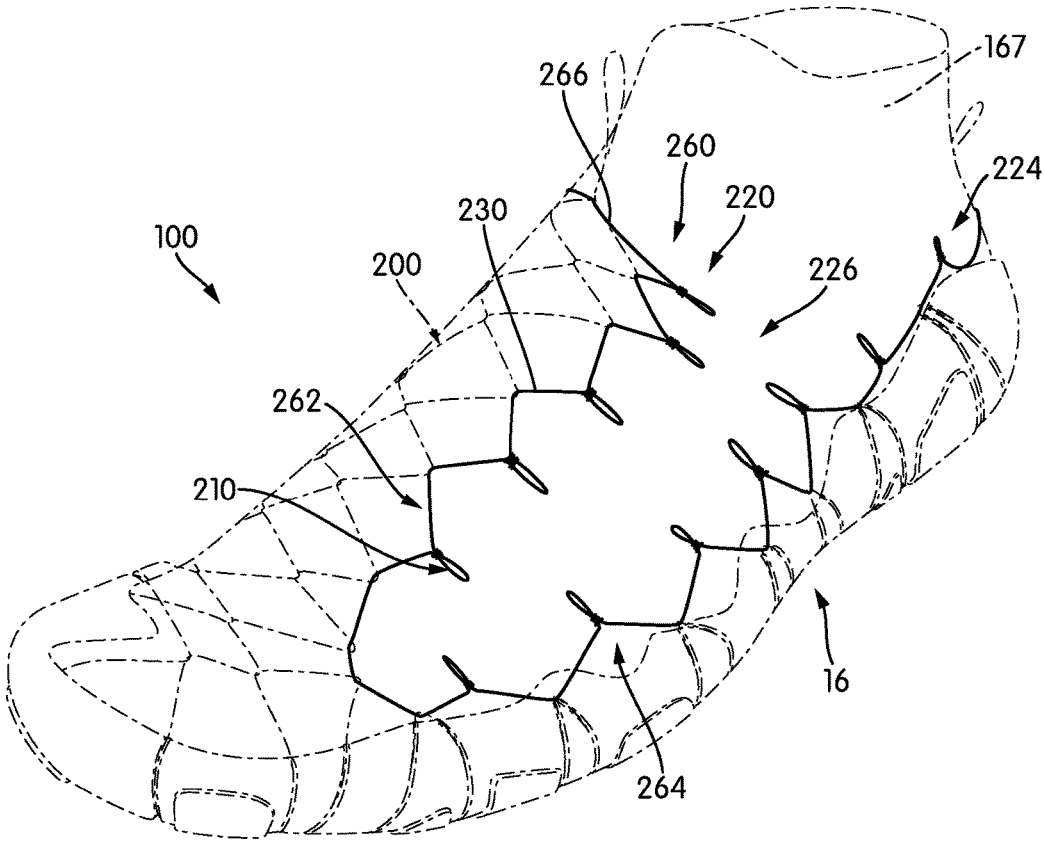
FIG. 4 is a schematic isometric view of an embodiment of an article of footwear with a mesh structure, in which the fastening region of the mesh structure is highlighted.

FIG. 4 is an isometric side view of an embodiment of article 100, in which upper 102, sole structure 110 and portions of mesh structure 200 are shown in phantom for purposes of illustration. As indicated in FIG. 4, mesh structure 200 includes a mesh periphery 260. Mesh periphery 260 comprises the outer edges of mesh structure 200. In the exemplary embodiment, mesh periphery 260 comprises a first mesh periphery portion 262 and a second mesh periphery portion 264, which extend along lateral side 16 of upper 102 in this embodiment. A third mesh periphery portion 266 extends around ankle portion 167 of upper 102.

First mesh periphery portion 262 and second mesh periphery portion 264 may be separated by a fastening gap 226. Additionally, first mesh periphery portion 262 and second mesh periphery portion 264 may be associated with fastener receiving portions. As used herein, fastener receiving portions may include loops, eyelets as well as other kinds of fastener receiving portions. Mesh structure 200 may include plurality of fastener receiving portions 210. Specifically, first mesh periphery portion 262 includes a first set of fastener receiving portions 220 and second mesh periphery portion 264 includes a second set of fastener receiving portions 224. In the embodiment depicted in FIG. 4, mesh structure 200 includes fastener receiving portions in the form of fastening loops.

In an exemplary embodiment, first mesh periphery portion 262, second mesh periphery portion 264 and plurality of fastener receiving portions 210 may all be comprised of a single cord 230. In particular, cord 230 may extend around first mesh periphery portion 262 and second mesh periphery portion 264. Moreover, at various intervals, cord 230 may be tied into loops that comprise fastener receiving portions 210. In other embodiments, however, first mesh periphery portion 262 and second mesh periphery portion 264 could comprise two or more cords, as well as possibly additional structures (such as overlays or eyestays). Further, in other embodiments, plurality of fastener receiving portions 210 may be formed of separate structures that are attached to cord 230 or some other portion of mesh structure 200.

In different embodiments, the shapes of first mesh periphery portion 262 and second mesh periphery portion 264 can vary. In at least one embodiment, first mesh periphery portion 262 and second mesh periphery portion 264 may have an approximate U-shape or V-shape, which define a U-shaped or V-shaped fastening gap 226. In other embodiments, however, the geometry of first mesh periphery portion 262 and second mesh periphery portion 264 could vary in any other manner and may be selected to achieve desired fastening properties.

The location of fastening gap 226, which is defined by first mesh periphery portion 262 and second mesh periphery portion 264, may vary in different embodiments. In some embodiments, fastening gap 226 may be disposed on a top portion or instep portion of upper 102. In other embodiments, fastening gap 226 could be disposed on lateral side 16 of article 100. In still other embodiments, fastening gap 226 could be disposed on medial side 18 of article 100. In the exemplary embodiment depicted in FIG. 4, fastening gap 226 may be disposed on lateral side 16. As seen in FIG. 3, for example, medial side 18 does not include a fastening gap or fastening cord. This arrangement may provide an asymmetric fastening configuration for article 100. This asymmetric configuration may prevent the fastening components (e.g., plurality of fastener receiving portions 210 and fastening cord 204) from interfering with kicks that occur between a ball and an instep of upper 102, or a ball and a medial side of upper 102.

In some embodiments, first mesh periphery portion 262 and second mesh periphery portion 264 may extend approximately in the longitudinal direction, from ankle portion 167 of upper 102 towards forefoot portion 10 of upper 102. In other embodiments, however, first mesh periphery portion 262 and second mesh periphery portion 264 could be oriented in any other manner such as laterally and/or vertically on article 100.

In different embodiments, the relative length and width of fastening gap 226, as defined by the lateral spacing between first mesh periphery portion 262 and second mesh periphery portion 264 may vary. In some embodiments, fastening gap 226 may have a length that is greater than half of the total length of article 100. In other cases, the length of fastening gap 226 could be between half and three-quarters of the total length of article 100. In still other cases, the length could be less than one half the length of article 100. Moreover, both the length and width of fastening gap 226 could be characterized by comparison with the average mesh spacing of mesh structure 200. In some cases, for example, fastening gap 226 could have a length approximately equal to five times the mesh spacing of mesh structure 200. In addition, in some cases, fastening gap 226 could have a width approximately equal to one or two times the mesh spacing of mesh structure 200.

Embodiments can include provisions to ensure that tension and support are evenly applied around an article by a mesh structure. In some embodiments, a fastening system can utilize fastening elements that are similar or even identical to the elements comprising the mesh structure. In particular, in some embodiments, a fastening cord may be substantially identical in material and/or material properties to cords comprising a mesh structure.

As clearly shown in FIG. 1, in at least some embodiments, plurality of cords 202 and fastening cord 204 could be substantially similar in one or more material properties and/or materials. Exemplary material properties that could be similar and/or identical include, but are not limited to: tensile strength, elasticity, frictional properties (relative to adjacent materials of an upper and/or sole structure), diameter, as well as other properties. In an exemplary embodiment, for example, at least one cord of plurality of cords 202 may have a first tensile strength, a first elasticity, a first coefficient of friction relative to upper 102 and a first diameter. Likewise, fastening cord 204 may have a second tensile strength, a second elasticity, a second coefficient of friction relative to upper 102 and a second diameter. In some cases, the first tensile strength and the second tensile strength may be substantially identical. Also, in some cases, the first elasticity and the second elasticity may be substantially identical. Also, in some cases, the first coefficient of friction and the second coefficient of friction may be substantially identical. Also, in some cases, the first diameter and the second diameter may be substantially identical. Using a fastening cord with similar properties to the remaining cords of mesh structure 200 may provide a substantially continuous degree of support, strength and tension around the entirety of article 100 such that a user is unable to feel any difference in support at the fastening region compared to other regions of article 100.

In other embodiments, one or more cords of plurality of cords 202 and fastening cord 204 may only be identical in some of the above discussed features. Still further, in other embodiments, fastening cord 204 could be different in multiple or even all of these features from one or more cords of plurality of cords 202. In another embodiment, for example, a lace could be used to secure fastening gap 226.

In different embodiments, fastening cord 204 and the cords of plurality of cords 202 could vary in material composition. In some cases, fastening cord 204 may be identical in material composition to one or more of plurality of cords 202. In other cases, fastening cord 204 may be substantially different to one or more of plurality of cords 202. Exemplary materials that could be used for one or more of plurality of cords 202 and/or fastening cord 204 include, but are not limited to cords comprised of: natural fibers (including vegetable fibers, wood fibers, animal fibers and mineral fibers), synthetic fibers (including regenerated fibers, synthetic fibers, nylon, modacrylic, olefin, acrylic, polyster, carbon fiber, etc.), as well as any other kinds of fibers or materials known in the art for making cords, ropes, string, yarns, and similar elements.

Figure 5:
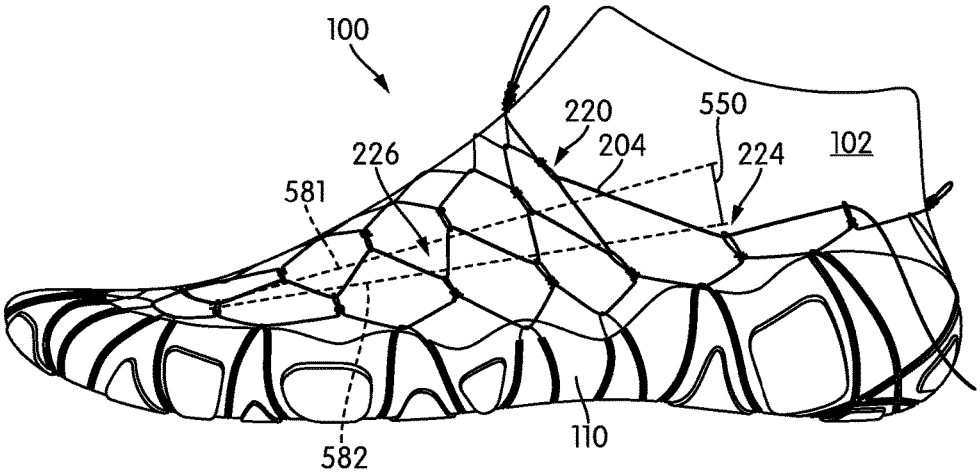
FIG. 5 is a schematic side view of an embodiment of an article of footwear with a mesh structure in a loosened fastening configuration.
Figure 6:
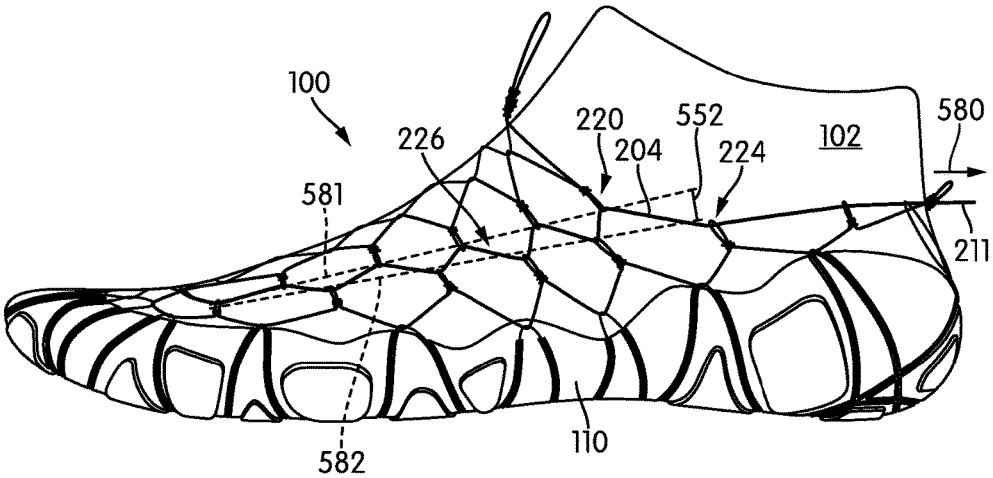
FIG. 6 is a schematic side view of an embodiment of an article of footwear with a mesh structure in a tightened fastening configuration.

FIGS. 5 and 6 illustrate side views of two configurations of article 100. In a first configuration, illustrated in FIG. 5, mesh structure 200 may be more open, or loose on upper 102. In a second configuration, illustrated in FIG. 6, mesh structure 200 may be closed, or tight on upper 102. Specifically, the width 550 of fastening gap 226 is greater in the first configuration (FIG. 5) than the width 552 of fastening gap 226 in the second configuration (FIG. 6). This is achieved by applying a tensioning force to (e.g., pulling) a free end portion 211 of fastening cord 204 in the second configuration. Here, the tensioning force is indicated schematically as force 580. For clarity, the width of fastening gap 226 is characterized as the separation between a first line 581 joining first set of fastener receiving portions 220 and a second line 582 joining second set of fastener receiving portions 224.

For purposes of clarity, the embodiments depict a fastening cord with a free end. In some embodiments, the free end of the fastening cord could be manually pulled and tied by a user, similar to the operation of conventional laces. In other embodiments, however, the free end of the fastening cord could be associated with additional provisions to maintain the tension in the fastening cord. For example, some embodiments could include cooperating fasteners (e.g., hook and loop fasteners, buttons, snaps or other kinds of fasteners) between the free end of the fastening cord and some fixed portion of an article. For example, in some embodiments the fastening cord could include a strap-like portion at its free end with one side of a hook and loop fastener that can engage a corresponding side of a hook and loop fastener fixed to a heel portion of the article.

It is also contemplated that embodiments could use a tensioning device to apply tension to a fastening cord, rather than having a user manually pull the cord. Examples of different tensioning devices include, but are not limited to: reel devices with a ratcheting mechanism, reel devices with a cam mechanism, manual tensioning devices, automatic tensioning devices, as well as possibly other kinds of tensioning devices. Examples of a tensioning device comprising a reel and ratcheting mechanism that could be used with the current embodiments are disclosed in Soderberg et al., U.S. Pat. No. 8,468,657, filed Nov. 20, 2009 and titled "Reel Based Lacing System", the entirety of which is hereby incorporated by reference. Examples of a motorized tensioning device that could be used with the current embodiments are disclosed in Beers, U.S. Patent Application Publication Number 2014/0070042, now U.S. patent application Ser. No. 14/014,555, filed Aug. 30, 2013, and titled "Motorized Tensioning System with Sensors," the entirety being incorporated by reference herein.

As shown in the figures, mesh structure 200 is configured to wrap around a substantial entirety of article 100. Specifically, mesh structure 200 may wrap around upper 102 in the forefoot, midfoot and heel regions, including both the lateral and medial sides. Likewise, mesh structure 200 also wraps around the forefoot, midfoot and heel regions of sole structure 110.

Figure 7:
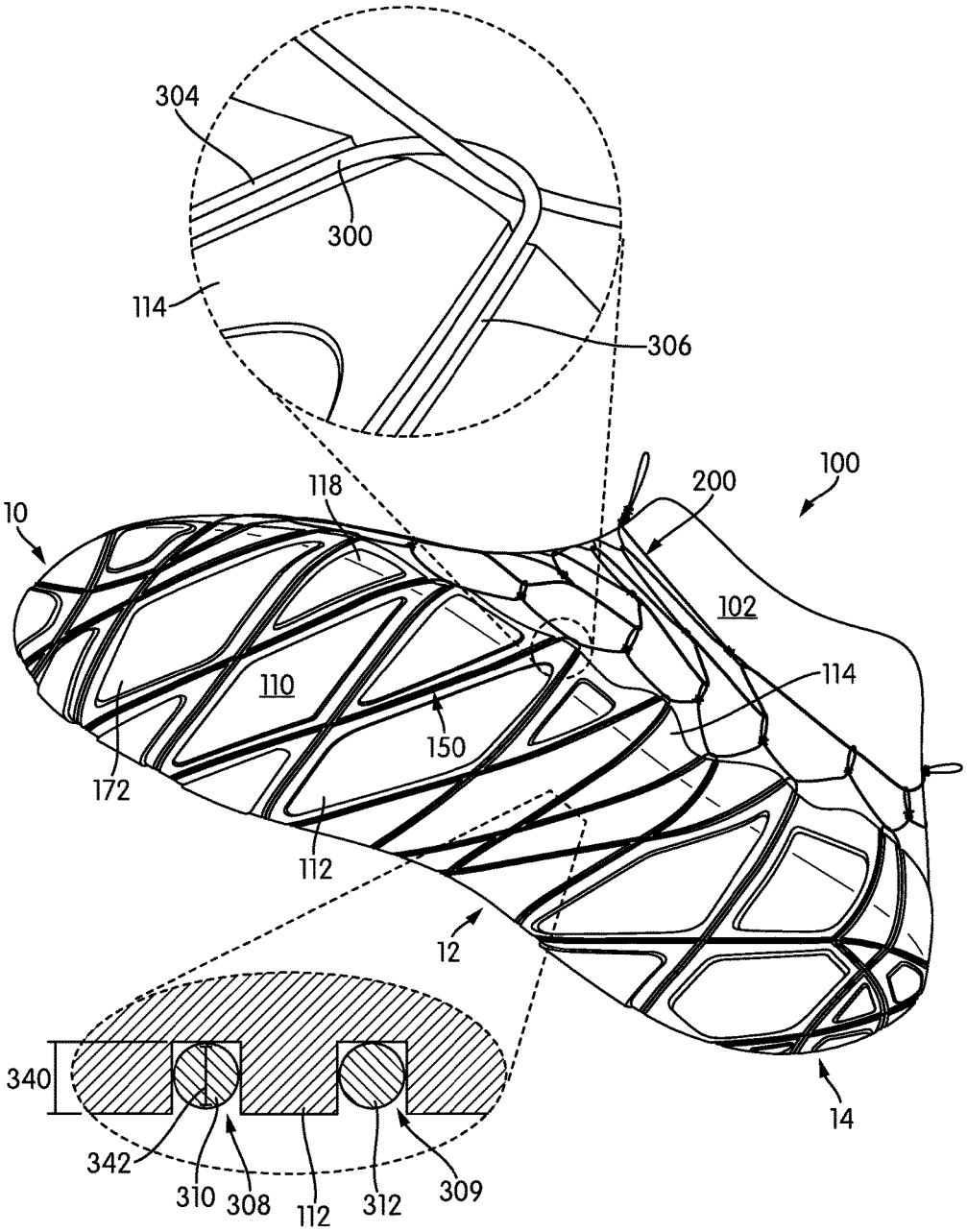
FIG. 7 is a schematic bottom isometric view of an embodiment of an article of footwear including a mesh structure.
Figure 8:
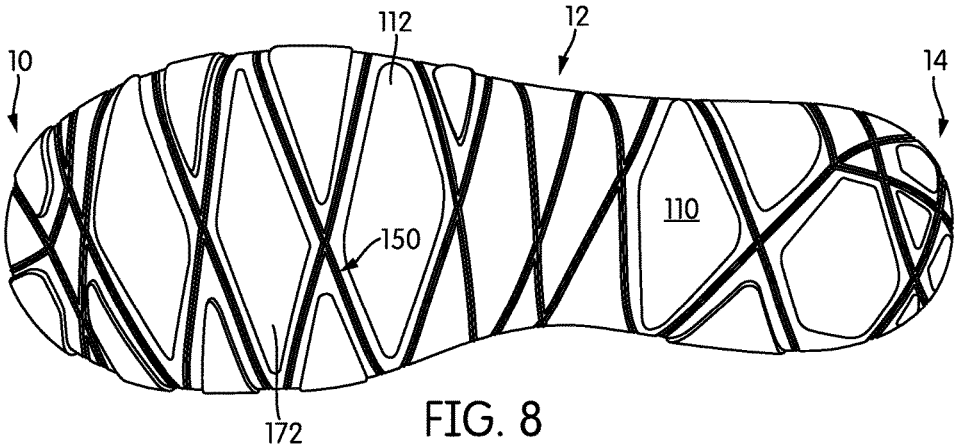
FIG. 8 is a schematic bottom view of an embodiment of an article of footwear including a mesh structure.

FIG. 7 illustrates a schematic bottom isometric view of an embodiment of article of footwear 100, including an enlarged isometric view of a portion of the side of sole structure 110, as well as an enlarged cross-sectional view of a bottom portion of sole structure 110. FIG. 8 illustrates a bottom view of an embodiment of article of footwear 100, in which bottom portion 112 of sole structure 110 is clearly visible.

Referring to FIGS. 7 and 8, sole structure 110 may include provisions to receive cords of mesh structure 200 and to retain the cords in fixed locations on sole structure 110. In some embodiments, sole structure 110 may include a plurality of channels 150 that are disposed on sole exterior surface 172. Plurality of channels 150 may extend through any portions of sole structure 110, including forefoot portion 10, midfoot portion 12 and heel portion 14.

In at least some embodiments, plurality of channels 150 may extend on both bottom portion 112 and side wall portion 114 of sole structure 110. As shown in the enlarged isometric view of FIG. 7, cord 300 may extend through both first channel 304 and second channel 306 of plurality of channels 150. In this case, the portions of first channel 304 and second channel 306 visible in the enlarged isometric view are disposed on side wall portion 114 of sole structure. As seen in the enlarged cross-sectional view of FIG. 7, a portion of cord 310 and of cord 312 may be disposed within a channel 308 and a channel 309, respectively, on bottom portion 112.

In the exemplary embodiment shown in FIG. 7, it may be clearly seen that some of plurality of channels 150 extend from side wall portion 114 of sole structure 110 to bottom portion 112 of sole structure 110. In particular, some of plurality of channels 150 may extend through peripheral portion 118 of sole structure 110, which is a peripheral boundary between side wall portion 114 and bottom portion 112. This arrangement allows mesh structure 200 to wrap around side wall portion 114 of sole structure 110, through peripheral portion 118 and onto bottom portion 112 of sole structure to better apply inward support the sides of the foot.

In different embodiments, the depths of the channels in sole structure 110 could vary. In some embodiments, each channel may be deep enough to receive a cord such that the cord is flush with, or recessed below, sole exterior surface 172. In other embodiments, however, each channel could have a depth that is less than the diameter of a cord, so that the cord may partially extend out of the channel. In the exemplary embodiment shown in FIG. 7, cord 310 is seen to have a diameter 342 that is slightly less than the depth 340 of channel 308. In some cases, the remaining channels of plurality of channels 150 could be configured in a similar manner, with depths greater or equal to the diameters of the corresponding cords received within each channel.

In different embodiments, the width of each channel could vary. In some embodiments, the width may be at least as wide as the diameter of a corresponding cord. In other embodiments, the width may be substantially greater than the diameter of a corresponding cord. In the exemplary embodiment depicted in FIG. 7, the width of channel 308 is approximately similar to the depth 340 of channel 308. Also, in the exemplary embodiment, the width of channel 308 may be similar to diameter 310 of corresponding cord 310.

Embodiments could utilize any patterns or arrangements for plurality of channels 150 within sole structure 110. In one embodiment, as depicted in FIG. 8, plurality of channels 150 can be configured to cross in a manner that provides diamond-like patterns on bottom portion 112. In other embodiments, however, plurality of channels 150 could be configured to cross in a manner that provides a variety of other kinds of geometric patterns, including but not limited to: triangular shapes, square shapes, rectangular shapes, regular polygonal shapes, irregular polygonal shapes as well as any other kinds of shapes including non-linear and/or irregular shapes.

The arrangement described here makes use of a plurality of channels to receive and to anchor portions of cords of mesh structure 200 on sole structure 110. This allows the relative position and orientation of mesh structure 200 to be partially fixed, at least at sole structure 110. Such a configuration may help reduce unwanted relative movement of mesh structure 200 over article 100, including resisting twisting, undesirable sliding and/or bunching of mesh structure 200 over article 100. This arrangement also helps reduce wear of the cords by reducing contact between cords on bottom portion 112 of sole structure 110 and a ground surface, since the cords may be recessed or flush with sole exterior surface 172.

Figure 9:
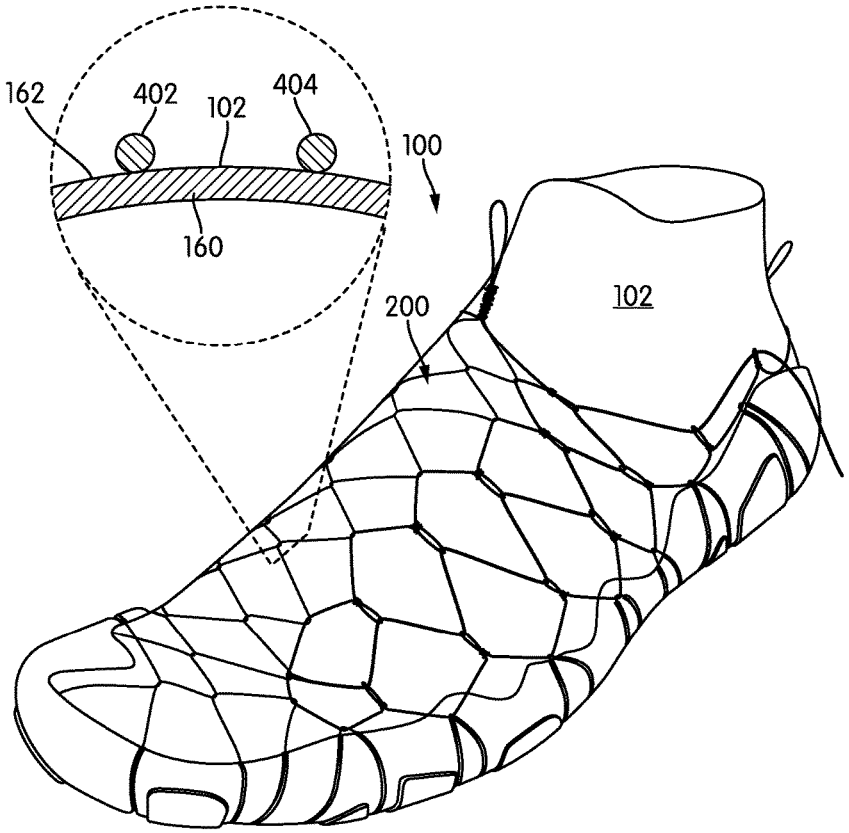
FIG. 9 is a schematic isometric view of an embodiment of an article of footwear with a mesh structure including an enlarged cross sectional view of a portion of an upper and the mesh structure.

FIG. 9 illustrates an isometric view of article 100 including an enlarged cross-sectional view of a portion of upper 102 and mesh structure 200. As shown in FIG. 9, first cord segment 402 and second cord segment 404 are disposed on upper exterior surface 162. Moreover, in at least some embodiments, first cord segment 402 and second cord segment 404 are not attached to upper 102, but are free to move relative to upper exterior surface 162. Furthermore, in the exemplary embodiment, no cords or cord segments may be directly attached, fixed or otherwise joined with upper 102.

Figure 10:
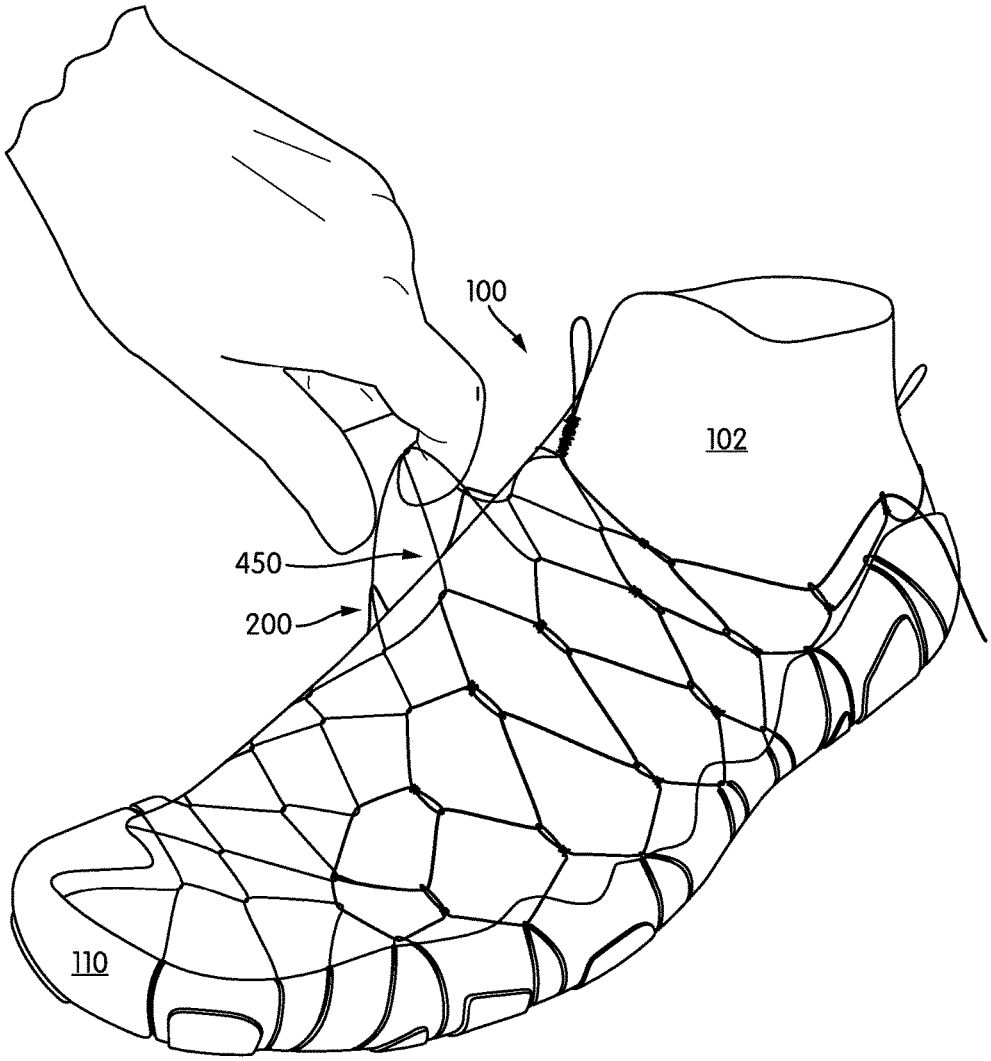
FIG. 10 is a schematic isometric view of an embodiment of the mesh structure of an article of footwear being pulled away from the upper of the article of footwear.

As shown in FIG. 10, for example, a user pulling on mesh structure 200 is able to displace a portion 450 of mesh structure 200 from upper 102. This configuration of a mesh structure 200 that is not attached at upper 102 allows mesh structure 200 to react dynamically as a foot moves within article 100. Specifically, as a foot bends and temporarily deforms upper 102, mesh structure 200 is able to adjust relative to upper 102 in order to better accommodate the adapted shape and contours of the foot.

Figure 11:
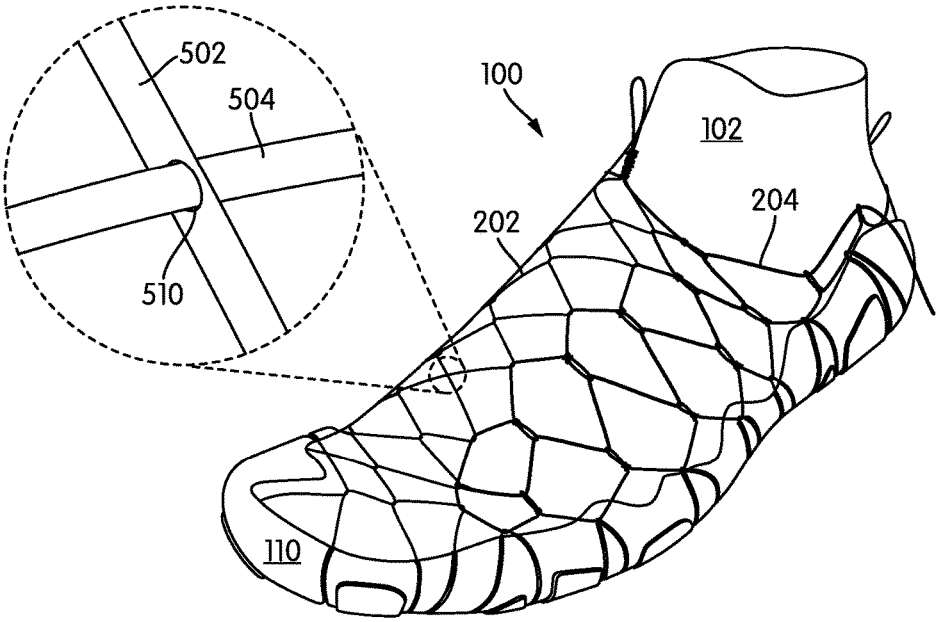
FIG. 11 is a schematic isometric view of an embodiment of an article of footwear including an enlarged view of an intersection between two cords.
Figure 12:
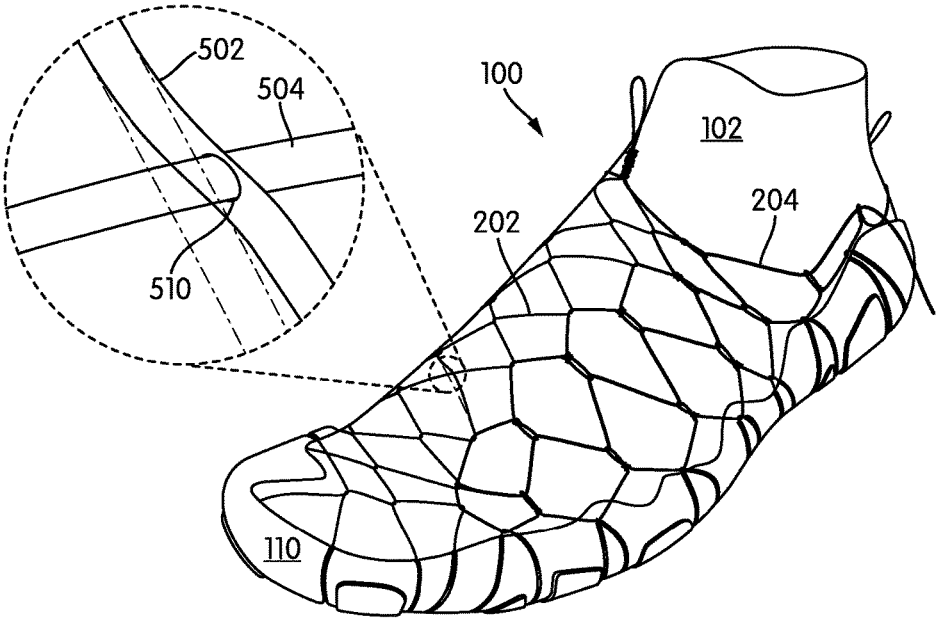
FIG. 12 is a schematic isometric view of an embodiment of an article of footwear including an enlarged view of an intersection between two cords, in which one cord has been displaced along another cord.

Embodiments can include provisions to improve the adaptability of mesh structure 200 as article 100 changes shape with the bending of a foot during use. FIGS. 11 and 12 illustrate isometric views of article 100 including enlarged isometric views of the intersection of a cord 502 and a cord 504. Referring to FIGS. 11 and 12, some embodiments may include cords that can be inserted through other cords at their intersections. For example, in FIG. 11, cord 504 can be threaded through cord 502 at an opening 510 of cord 520. This allows for some sliding of cord 502 along the length of cord 504, such that their intersection can be displaced. Using similar configurations at multiple intersections of cord segments in mesh structure 200 may allow for a more dynamic mesh structure 200 that can vary in response to variations in the required support for a foot.

In order to achieve the kind of arrangement depicted in FIGS. 11 and 12, some embodiments may utilize cords of different gauges. For example, in some cases, cord 502 may be a heavier gauge cord than cord 504. This ensures that cord 504 may be threaded through cord 502 with enough remaining material around opening 510 of cord 502 so that the tensile strength of cord 502 is not significantly reduced.

Figure 13:
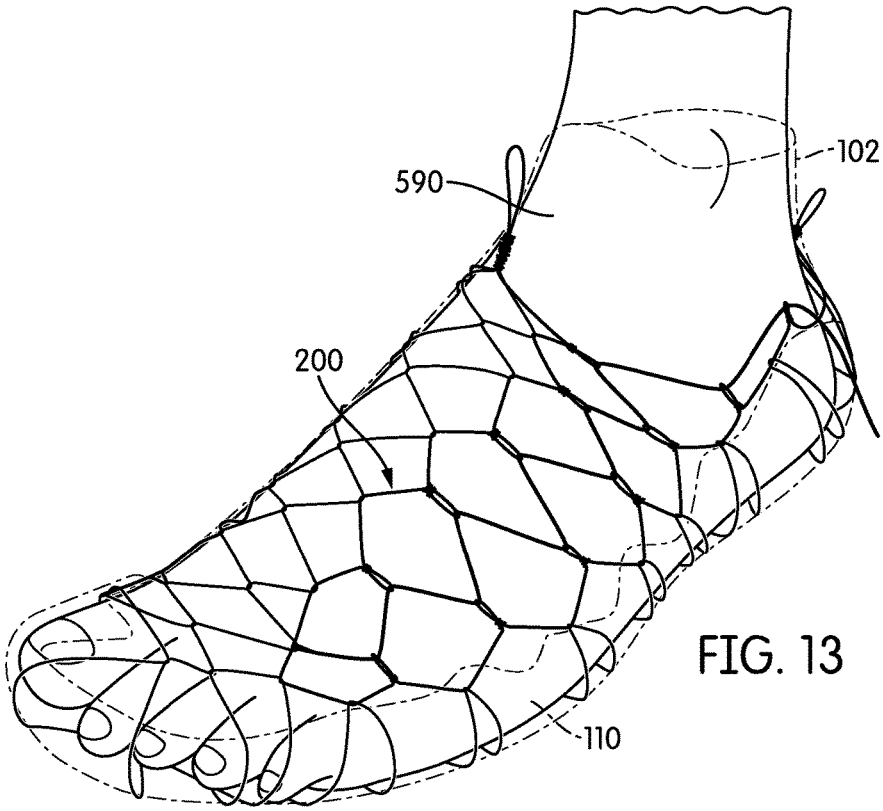
FIG. 13 is a schematic isometric view of an embodiment of an article of footwear with a mesh structure being worn on a foot, in which the upper and sole structure are shown in phantom.
Figure 14:
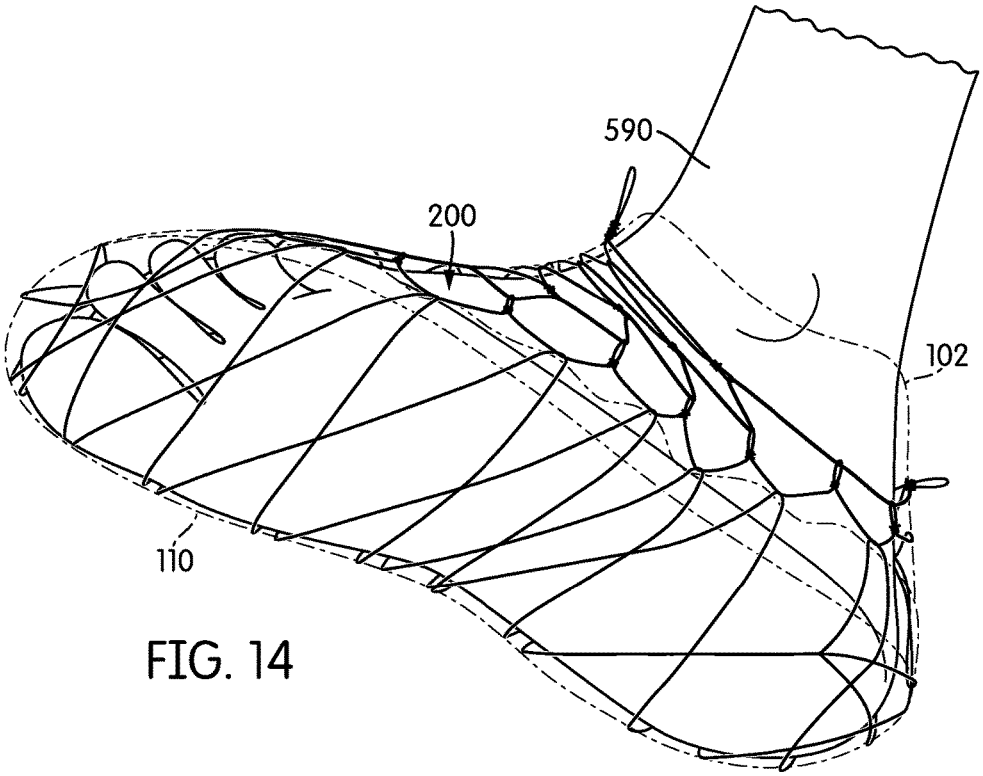
FIG. 14 is a schematic bottom isometric view of an embodiment of an article of footwear with a mesh structure being worn on a foot, in which the upper and sole structure are shown in phantom.
Figure 15:
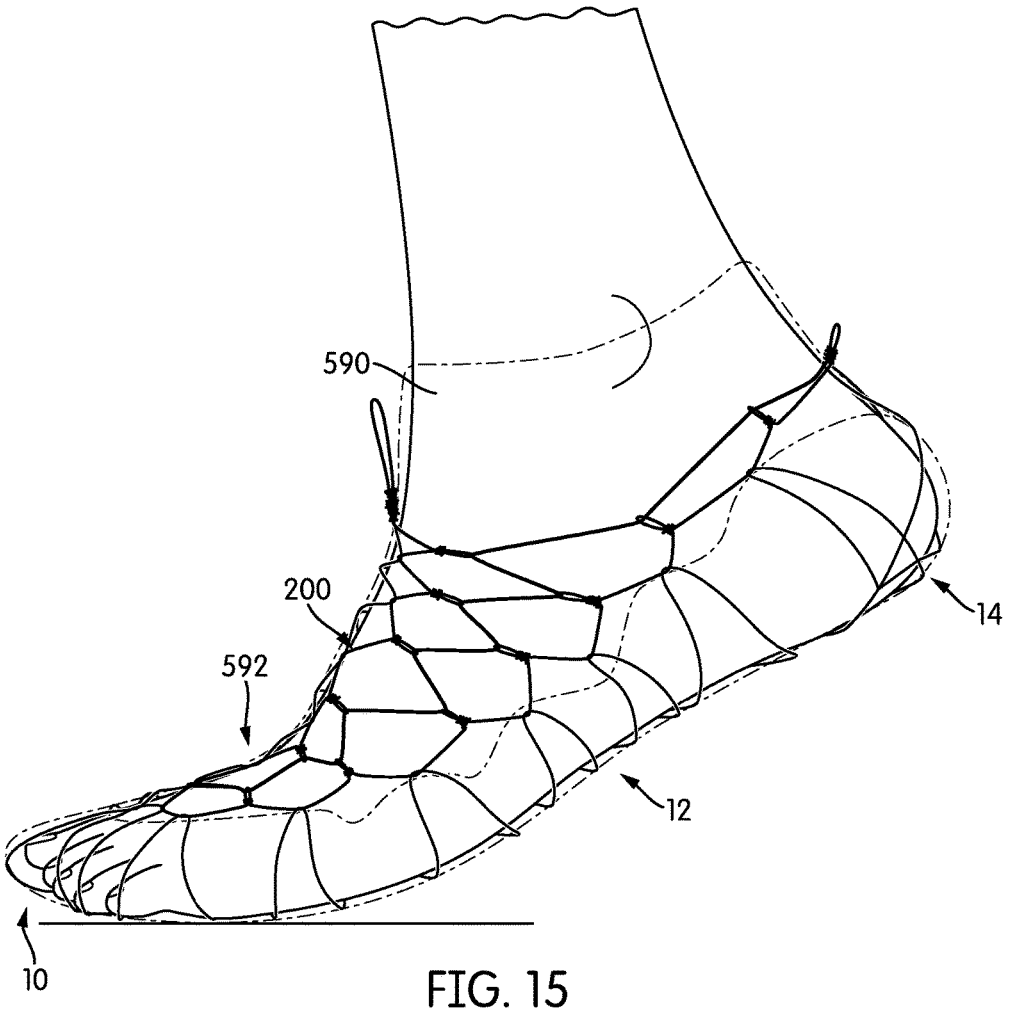
FIG. 15 is a side schematic view of an embodiment of a mesh structure providing dynamic support to a foot during use.

FIGS. 13-15 illustrate various views of article 100 being worn on a foot 590. For purposes of illustration, upper 102 and sole structure 110 are shown in phantom so as to better show the way that mesh structure 200 provides full 360 degree coverage of foot 590. In particular, it is clear from FIGS. 13 and 14 that mesh structure 200 provides coverage of the instep, sides, bottom, toes and heel of foot 590. Thus, mesh structure 200 can be seen to wrap or cradle foot 590 by applying supporting forces to across upper 102 and sole structure 110.

The degree of dynamic support provided by mesh structure 200 is clearly shown in FIG. 15, which shows article 100 and foot 590 in dynamic motion. Referring to FIG. 15, foot 590, along with upper 102 and sole structure 110 bend at forefoot portion 10, creating a bending region 592. Because mesh structure 200 reacts dynamically, mesh structure 200 readily adapts to the new contours of article 100 created by bending region 592. Specifically, mesh structure 200 conforms to the geometry of bending region 592 and simultaneously provides support to forefoot portion 10, midfoot portion 12 and heel portion 14 of article 100 (and foot 592).

Figure 16:
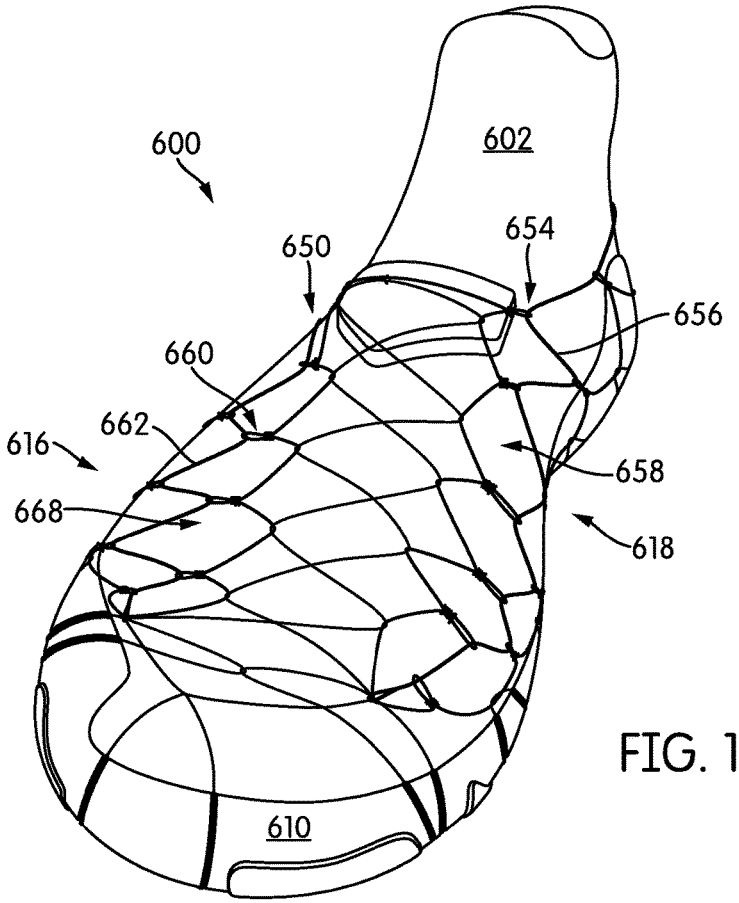
FIG. 16 is a schematic front isometric view of an embodiment of an article of footwear with a mesh structure including two fastening cords.
Figure 17:
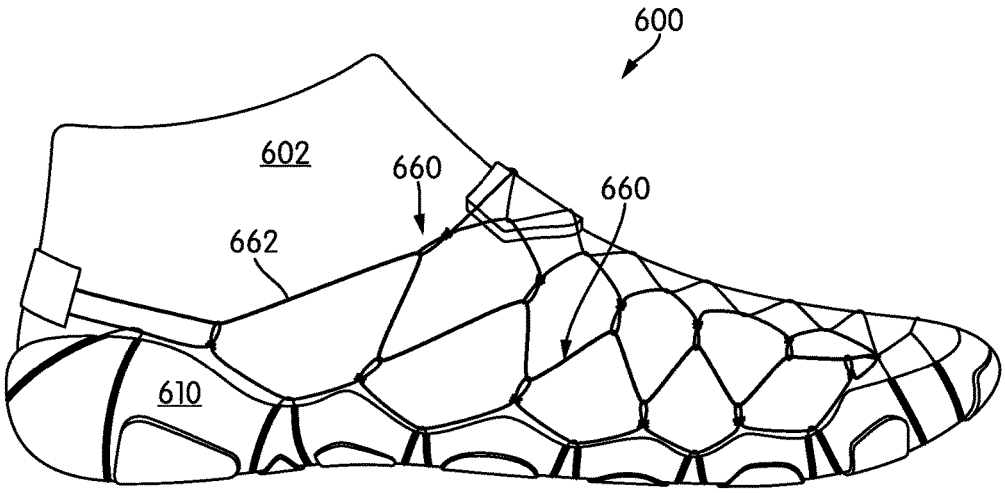
FIG. 17 is a schematic lateral side view of an embodiment of an article of footwear with a mesh structure including two fastening cords.

FIGS. 16 and 17 illustrate an isometric view and a side view, respectively, of another embodiment of an article of footwear 600 (or article 600). It is to be understood that article 600 may be substantially similar in many respects to article 100 described above and shown in FIGS. 1-15. In particular, although only some features of article 600 are described below for purposes of clarity, it should be understood that any or all of the features described with respect to article 100 could be applied to article 600.

Article 600 may include upper 602 and sole structure 610. In addition, article 600 includes a mesh structure 650. In this embodiment, mesh structure 650 comprises two fastening regions. Specifically, mesh structure 650 includes first set of fastener receiving portions 654 and first fastening cord 656 on medial side 618. First fastening cord 656 extends across a first fastening gap 658. Mesh structure 650 also includes second set of fastener receiving portions 660 and second fastening cord 662 on lateral side 616. Second fastening cord 662 extends across second fastening gap 668. The configuration shown in FIGS. 16 and 17 provides a symmetric arrangement in which mesh structure 650 can be tightened on both lateral side 616 and medial side 618. As with previous embodiments, the locations for the two fastening regions of the embodiment depicted in FIGS. 16 and 17 may help reduce interference between a ball and fastening cords during some kicks, such as kicks where the instep contacts the ball.

Figure 18:
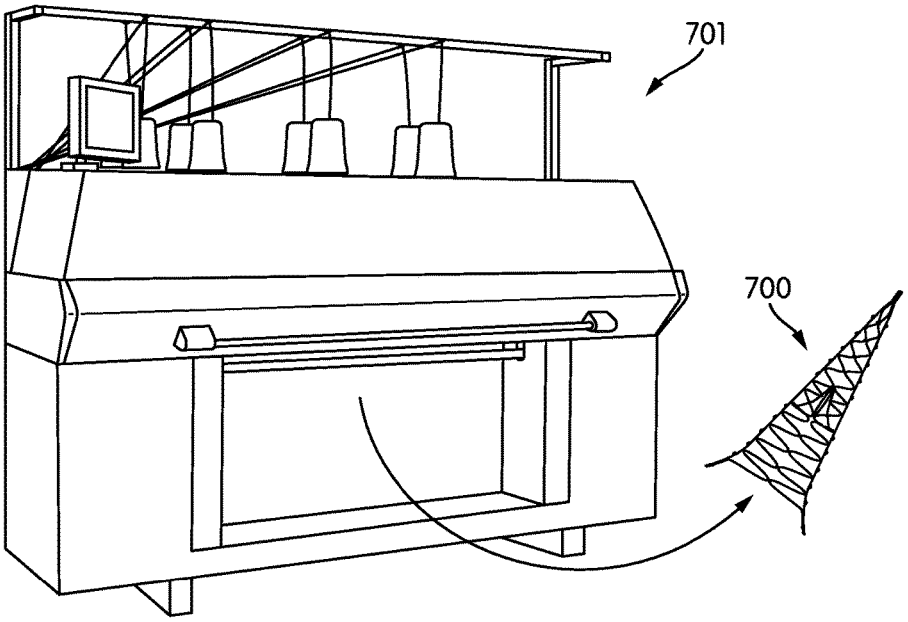
FIG. 18 is a schematic view of an embodiment of a flat knitting machine and a knit mesh structure formed using the flat knitting machine.

FIGS. 18 through 23 illustrate views of another embodiment of a mesh structure as well as a method for making an article including a mesh structure. In the embodiment of FIGS. 18-22, a mesh structure can be formed from a knitting process. FIG. 18 illustrates a schematic view of a flat knitting machine 701 and a knit mesh structure 700 that is formed using flat knitting machine 701. The term "knit mesh structure" as used herein refers to a knitted material element that has a mesh configuration or a net-like configuration. In the exemplary embodiments described herein, a knit mesh structure may be configured with similar mesh properties to the embodiments described above and shown in FIGS. 1-17. Specifically, the mesh structure may have a relatively wide spacing when assembled with an article, such that the spacing is approximately in the range between 1 and 20 percent of the total length of the corresponding article.

In contrast to previous embodiments that may be assembled from multiple cords that are knotted, braided, twisted, looped, threaded-through or otherwise joined to form a mesh structure, a knit mesh structure is formed using a knitting process from individual yarns or threads, rather than from multiple cords.

Flat knitting, when used in example structures according to the embodiments, can provide various advantages. By selectively placing multiple different yarns and/or stitch patterns at multiple different locations in the overall structure during the knitting process, flat knitted products may have multiple different physical properties (e.g., different stretchability, different moisture management capabilities, etc.) at multiple different locations or zones within a single, unitary construction (e.g., different properties at different zones or locations within a single footwear structure).

The mesh structure embodiments may make use of any of the flat knitting processes, materials and/or other features disclosed in Dua et al., U.S. Pat. No. 7,774,956, filed Nov. 10, 2006 and entitled "Article of Footwear Having a Flat Knit Upper Construction or Other Upper Construction," the entirety of this application being incorporated by reference herein.

Of course, the embodiments need not be limited to flat knitting processes or machines. In some embodiments, the mesh structure of the embodiments may be formed using a warp-knitting machine, thereby forming a warp-knit mesh structure. Still other embodiments could utilize any other kind of knitting process, knit structure and or knitting machines for creating a desired knit structure.

Figure 19:
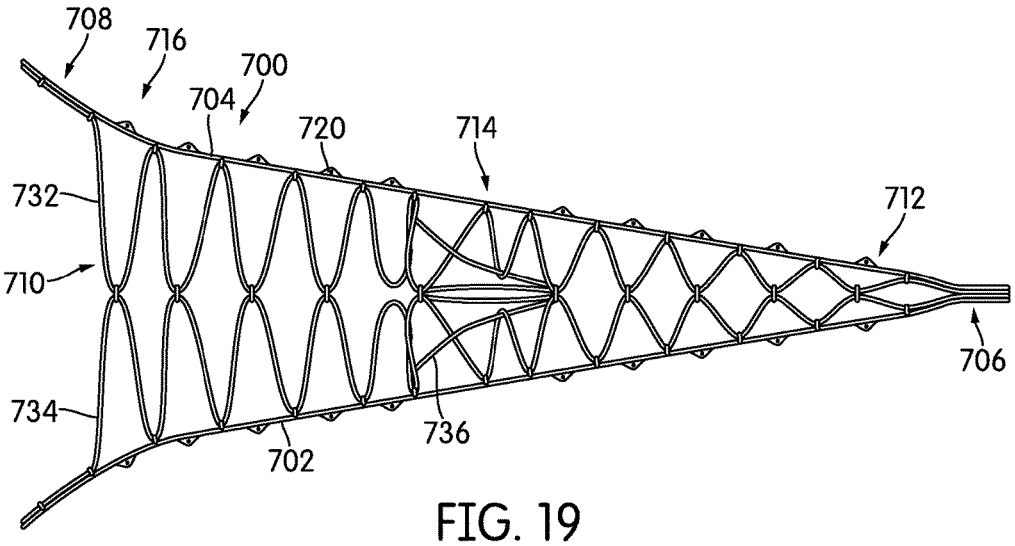
FIG. 19 is a schematic view of an embodiment of a knit mesh structure.

FIG. 19 illustrates a schematic view of a knit mesh structure 700. Knit mesh structure 700 may include a first end 706 and a second end 708. Knit mesh structure 700 further includes a first portion 712, a second portion 714 and a third portion 716. Second portion 714 may be disposed between first portion 712 and third portion 716.

Knit mesh structure 700 is comprised of various knitted segments. For example, knit mesh structure 700 includes a first side peripheral segment 702 that forms a side edge of knit mesh structure 700. Knit mesh structure 700 also includes a second side peripheral segment 704 that forms an opposing side edge of knit mesh structure 700. Both first side peripheral segment 702 and second side peripheral segment 704 extend from first end 706 to second end 708.

Knit mesh structure 700 may include additional knit segments that extend between first side peripheral segment 702 and second side peripheral segment 704. In the exemplary embodiment shown in FIG. 19, knit mesh structure 700 may include a plurality of interior segments 710 that are disposed between first side peripheral segment 702 and second side peripheral segment 704.

Interior segments 710 may be configured in a variety of different patterns. In an exemplary embodiment, interior segments 710 comprise various knitted segments having a wave-like configuration. For example, interior segments 710 may include a first wavy segment 732 that extends through first portion 712, second portion 714 and third portion 716 of knit mesh structure 700. Additionally, a second wavy segment 734 may also extend through first portion 712, second portion 714 and third portion 716. Moreover, in some cases, first wavy segment 732 may extend in parallel with second wavy segment 734.

In at least some embodiments, additional knitted segments may be included. For example, in some cases second portion 714 includes a knit segment 736 that generally extends in a direction perpendicular to the knit segments of first wavy segment 732 and second wavy segment 734. In some embodiments, knit segment 736 may be positioned to increase support at a toe region of an article, as can be seen in FIGS. 20-23.

The exemplary embodiment shown in FIG. 19 illustrates a particular mesh pattern for knit mesh structure 700. Other embodiments could use any other patterns including patterns with any combinations of linear and non-linear knitted segments. The particular mesh pattern used may be selected to achieve optimal support and comfort for a user's foot.

Some embodiments can incorporate fastener receiving portions. In the exemplary embodiment, knit mesh structure 700 includes fastener receiving portions 720 in the form of eyelets. Fastener receiving portions 720 may be formed on first side peripheral segment 702 and second side peripheral segment 704. Fastener receiving portions 720 may receive a fastening cord, or any other fastening provision such as a lace.

Figure 20:
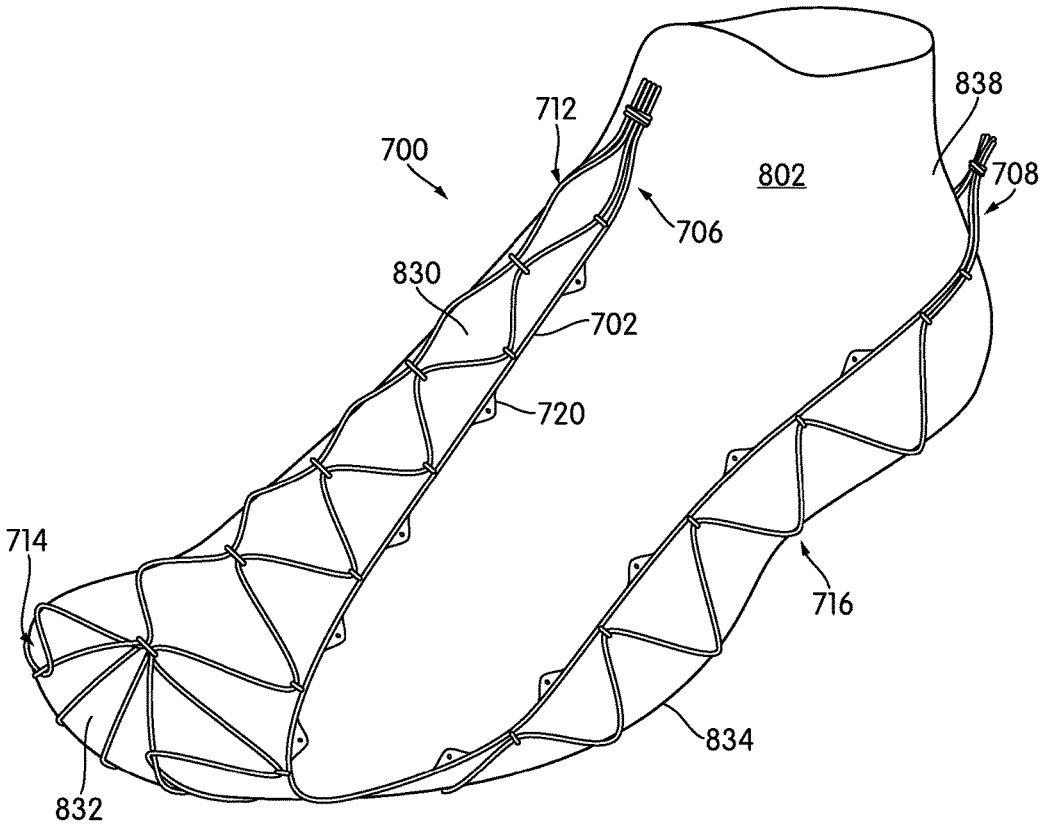
FIG. 20 is a schematic view of a step in a process for making an article with a knit mesh structure.
Figure 21:
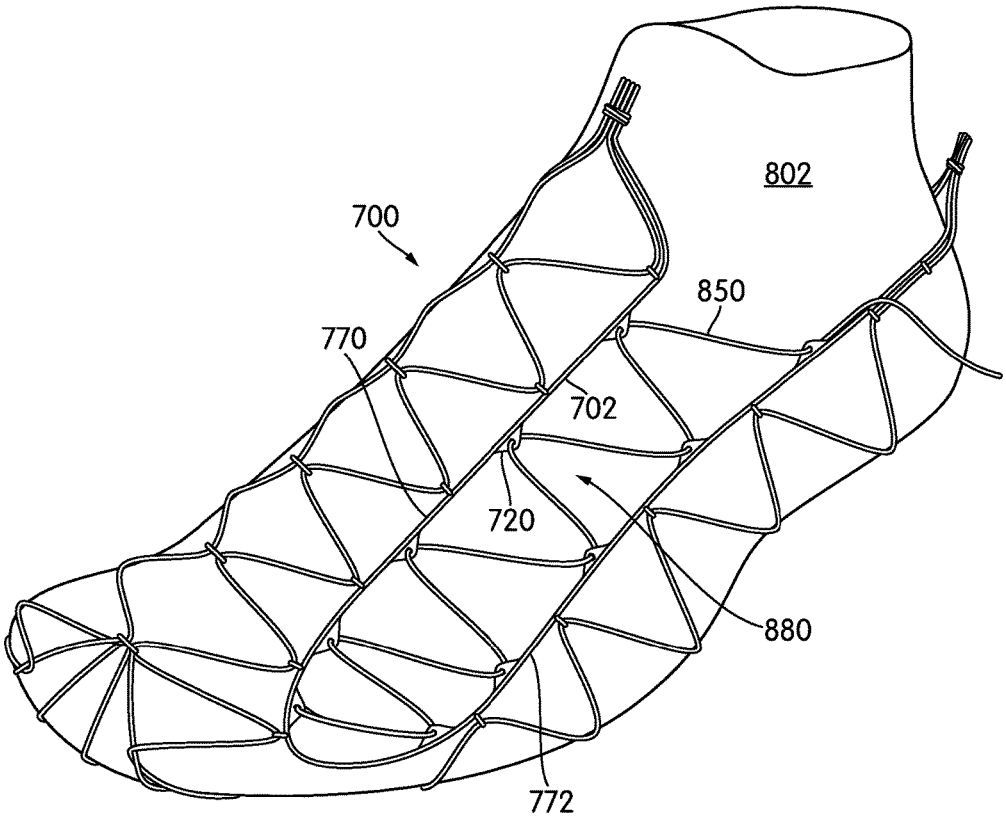
FIG. 21 is a schematic view of a step in a process for making an article with a knit mesh structure.
Figure 22:
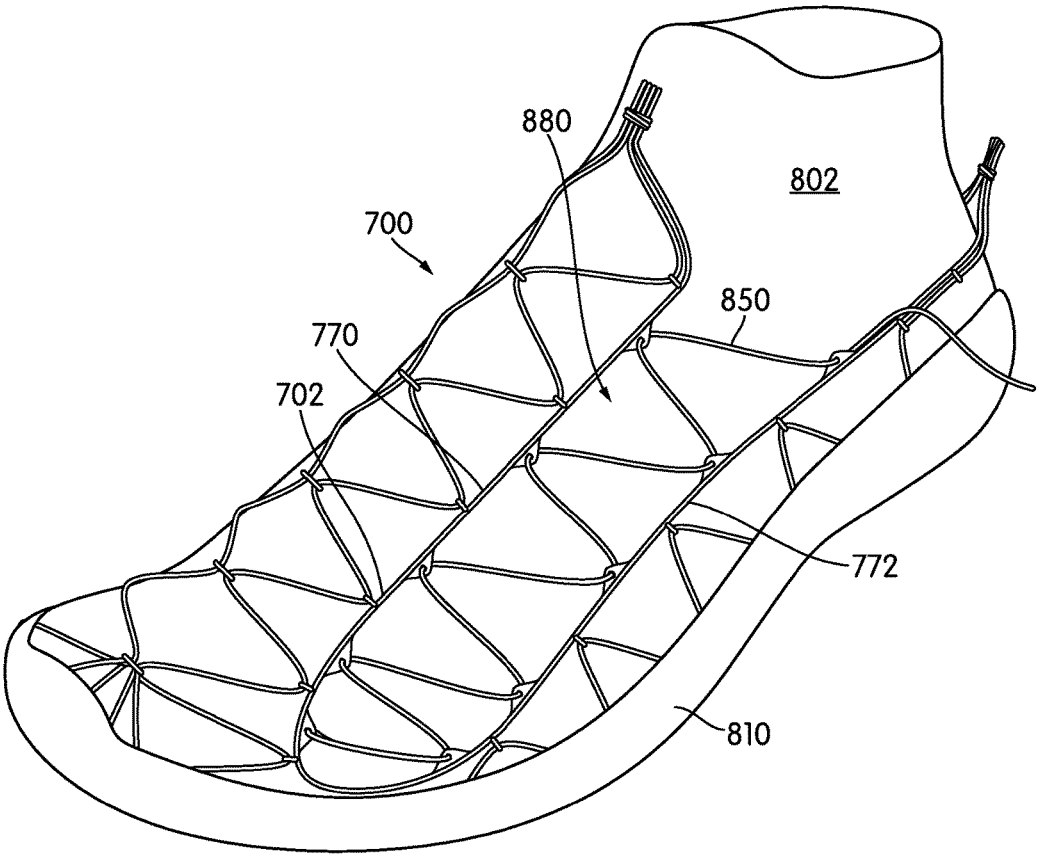
FIG. 22 is a lateral isometric view of an embodiment of an article of footwear with a knit mesh structure.

FIGS. 20-22 illustrate an exemplary embodiment of a process for making an article having a knit mesh structure for support. Referring first to FIG. 20, upon receiving an upper 802, knit mesh structure 700 may be wrapped around portions of upper 802. Specifically, first portion 712 of knit mesh structure 700 may be wrapped, stretched or otherwise place onto a top portion 830 of upper 802. Top portion 830 may include an instep portion of upper 802. Second portion 714 of knit mesh structure 700 may be wrapped, stretched or otherwise placed around toe portion 832 of upper 802. Also, third portion 716 of knit mesh structure 700 may be stretched, wrapped or otherwise placed onto bottom portion 834 of upper 802. In at least some cases, second end 708 of knit mesh structure 700 may be pulled against heel portion 838 of upper 802.

Next, fastening cords may be inserted through fastener receiving portions 720 of knit mesh structure 700. FIG. 21 illustrates a schematic view of a fastening member 850 being inserted through fastener receiving portions 720. This provides a means to fasten a first fastening gap 880 that extends between first portion 770 and second portion 772 of first side peripheral segment 702. A similar process may be used to fasten a second fastening gap 882 that extends between first portion 780 and second portion 782 of second side peripheral segment 704 (see FIG. 23). Specifically, a fastening member 852 may be used to tighten second fastening gap 882. Although the embodiment depicts fastening cords for fastening knit mesh structure 700, other embodiments may utilize any kinds of tensioning elements known in the art, including any kinds of cords, laces, wires, ropes, straps or similar kinds of elements.

With this configuration, knit mesh structure 700 may be configured to provide 360 degree coverage or support for a foot, since the combination of knit mesh structure 700 with first fastening member 850 and second fastening member 852 wrap 360 degrees around upper 802 and provide tension in 360 degrees around upper 802. Thus, as with the previous embodiment described above and shown in FIGS. 1-17, knit mesh structure 700 provides full 360 degree support to a foot during use.

Figure 23:
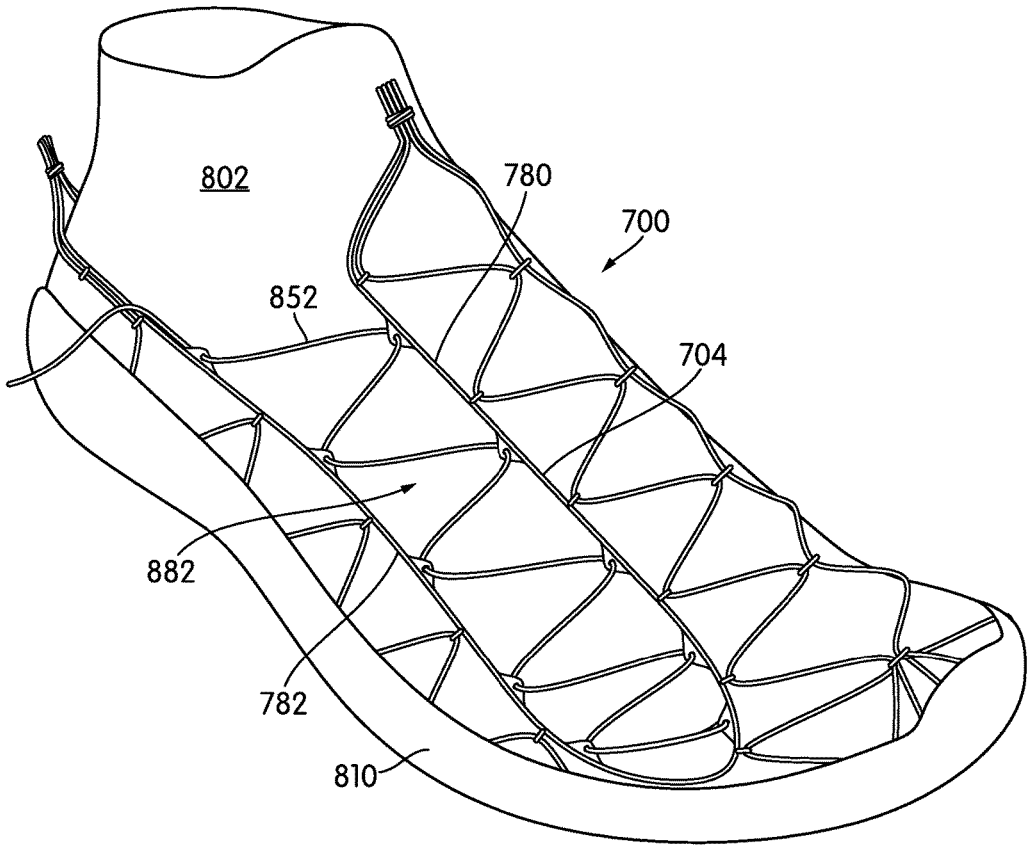
FIG. 23 is a medial isometric view of an embodiment of an article of footwear with a knit mesh structure.

Finally, as shown in FIGS. 22 and 23, a sole structure 810 may be assembled with upper 802 in order to form a finished article. Specifically, sole structure 810 may be placed against both upper 802 and portions of knit mesh structure 700, such that portions of knit mesh structure 700 (e.g., third portion 716) are disposed between upper 802 and sole structure 810.

It will be understood that embodiments using a knit mesh structure can be configured with similar provisions to those taught for the mesh structures described above and shown in FIGS. 1-17. For example, while the exemplary embodiment in FIGS. 18-23 depict a knit mesh structure that is disposed between an upper and a sole structure, in other embodiments a knit mesh structure could be configured to wrap around the exterior surface of a sole structure. Moreover, in some embodiments, a sole structure could include channels on the exterior surface to receive knitted segments of a knit mesh structure. Still other embodiments could make use of any of the other features described above in any of the other disclosed embodiments.

Embodiments can include provisions facilitate the positioning, orientation and movement of cords, or other kinds of tensioning elements. Some embodiments can include one or more provisions to partially or fully receive cords. For example, in some embodiments the upper and/or sole may include one or more channels to receive some or all of a cord.

FIGS. 24-27 illustrate various schematic isometric views of an embodiment of an article of footwear 900 that includes a mesh structure 950. It will be understood that article of footwear 900, also referred to simply as article 900, may be similar in a least some respects to articles disclosed in previous embodiments. For example, article 900 may include an upper 902 and a sole structure 912. Moreover, it may be appreciated that mesh structure 950 may be similar in at least some respects to mesh structure 200 described previously and shown in FIGS. 1-17, as well as knit mesh structure 700 described previously and shown in FIGS. 18-23. In other words, in at least some embodiments, mesh structure 950 may include any of the provisions described earlier with regards to either mesh structure 200 or knit mesh structure 700, as well as any of the provisions for a mesh structure described elsewhere in this detailed description.

Figure 24:
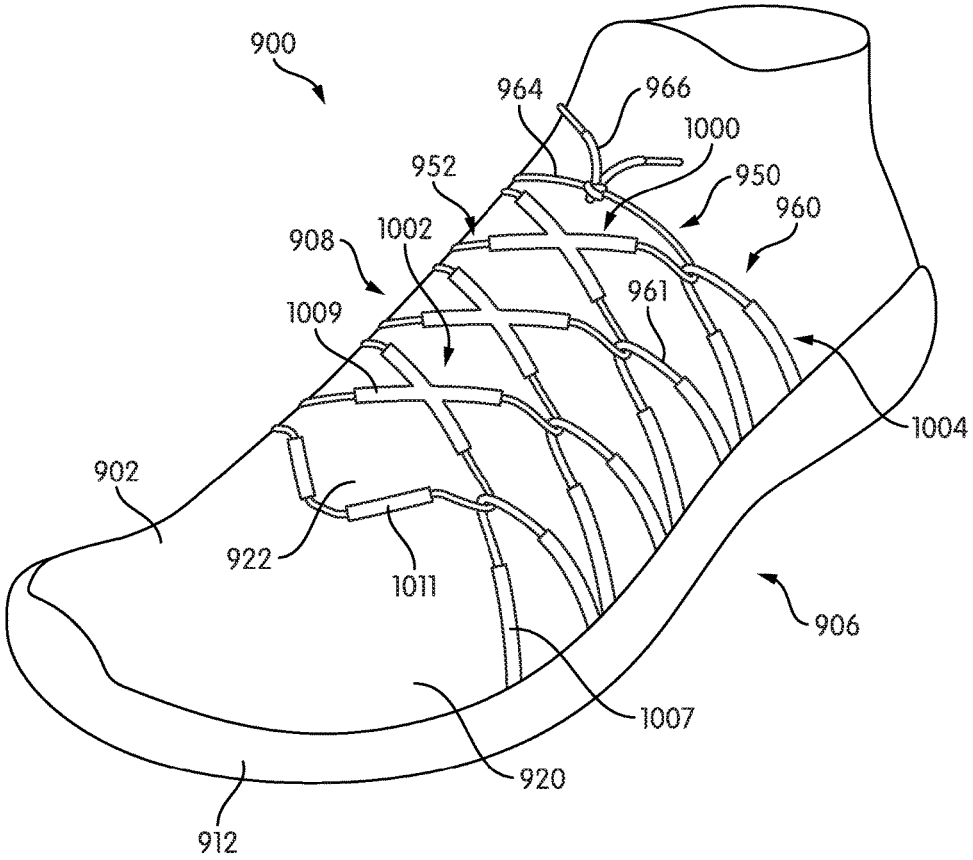
FIG. 24 is a lateral schematic isometric view of an embodiment of an article of footwear with a mesh structure, in which the article includes various channels for receiving cords of the mesh structure.
Figure 25:
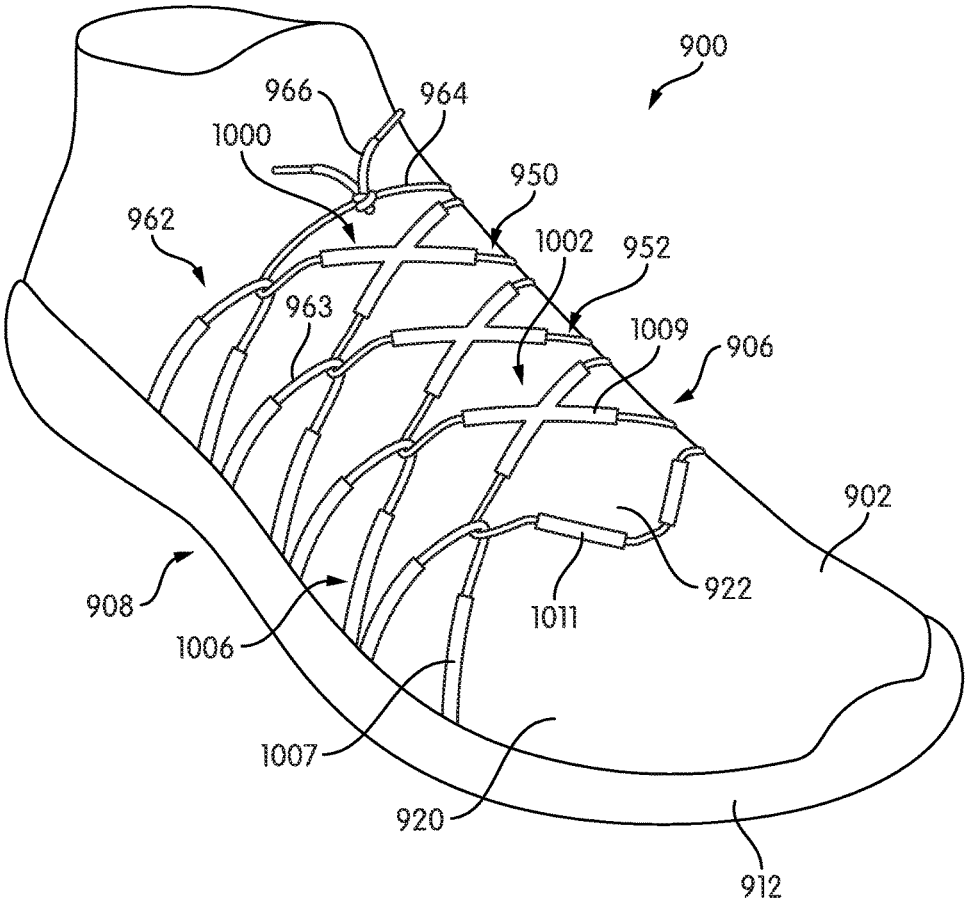
FIG. 25 is a medial schematic isometric view of an embodiment of an article of footwear with a mesh structure, in which the article includes various channels for receiving cords of the mesh structure.

FIGS. 24 and 25 illustrate a schematic lateral isometric view and a schematic medial isometric view, respectively, of article 900 and mesh structure 950. As shown in FIGS. 24-25, mesh structure 950 may be comprised of one or more distinct cords. Specifically, mesh structure 950 may be comprised of a plurality of cords 952. In at least some embodiments, plurality of cords 952 is further comprised of a first side cord group 960 (see FIG. 24), a second side cord group 962 (see FIG. 25) and a central cord 964.

Generally, the number of cords comprising each cord group could vary between one cord and multiple cords. For example, in some embodiments, first side cord group 960 could be comprised of a single cord that runs from a lower portion 920 of upper 902 to instep portion 922 in an alternating path, thereby forming each of the individual cord segments 961 that are visible on lateral side 906 of article 900. In other embodiments, however, two or more of the visible cord segments 961 could comprise distinct cords that are disconnected and individually anchored on lower portion 920 of upper 902. Thus, in some embodiments, first side cord group 960 could comprise four distinct cords that each extend in an up-side-down U configuration on lateral side 906. In an exemplary embodiment, it is contemplated that cord segments 961 comprise portions of a single cord that is arranged into four loop-like features on lateral side 906. Moreover, any of these possible provisions for first side cord group 960 may also be used for second side cord group 962 on medial side 908 of article 900. In particular, in different embodiments, the visible cord segments 963 of second side cord group 962 could be portions of distinct cords or portions of a single cord.

As shown in both FIGS. 24-25, central cord 964 may extend through instep portion 922 and engage both first side cord group 960 as well as second side cord group 962. In particular, in some embodiments, central cord 964 may pass through the loop-like portions of cord segments 961 on lateral side 906 and through the loop-like portions of cord segments 963 on medial side 908 in an alternating fashion. This arrangement may allow central cord 964 to act as a fastening cord. Specifically, in embodiments where the ends 966 of central cord 964 can be tensioned and tied, central cord 964 may pull lateral side 906 and medial side 908 of upper 902 closer together, thereby tightening upper 902 around a foot. Although the exemplary embodiment depicts ends 966 of central cord 964 being tied together, other embodiments could utilize any kind of fastening mechanism, including automated or manual tensioning devices.

Figure 26:
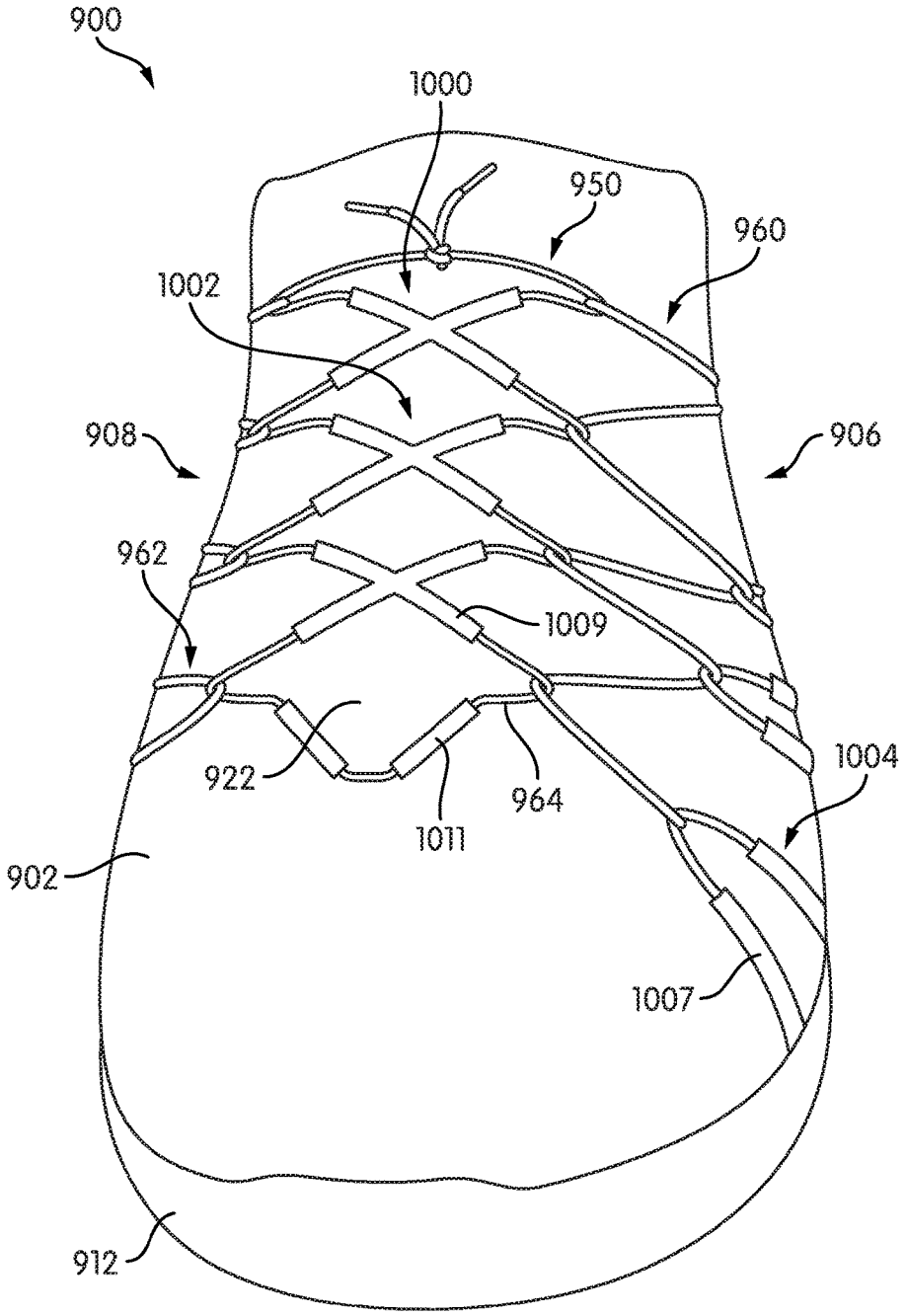
FIG. 26 is a front schematic view of the article of footwear of FIG. 24.
Figure 27:
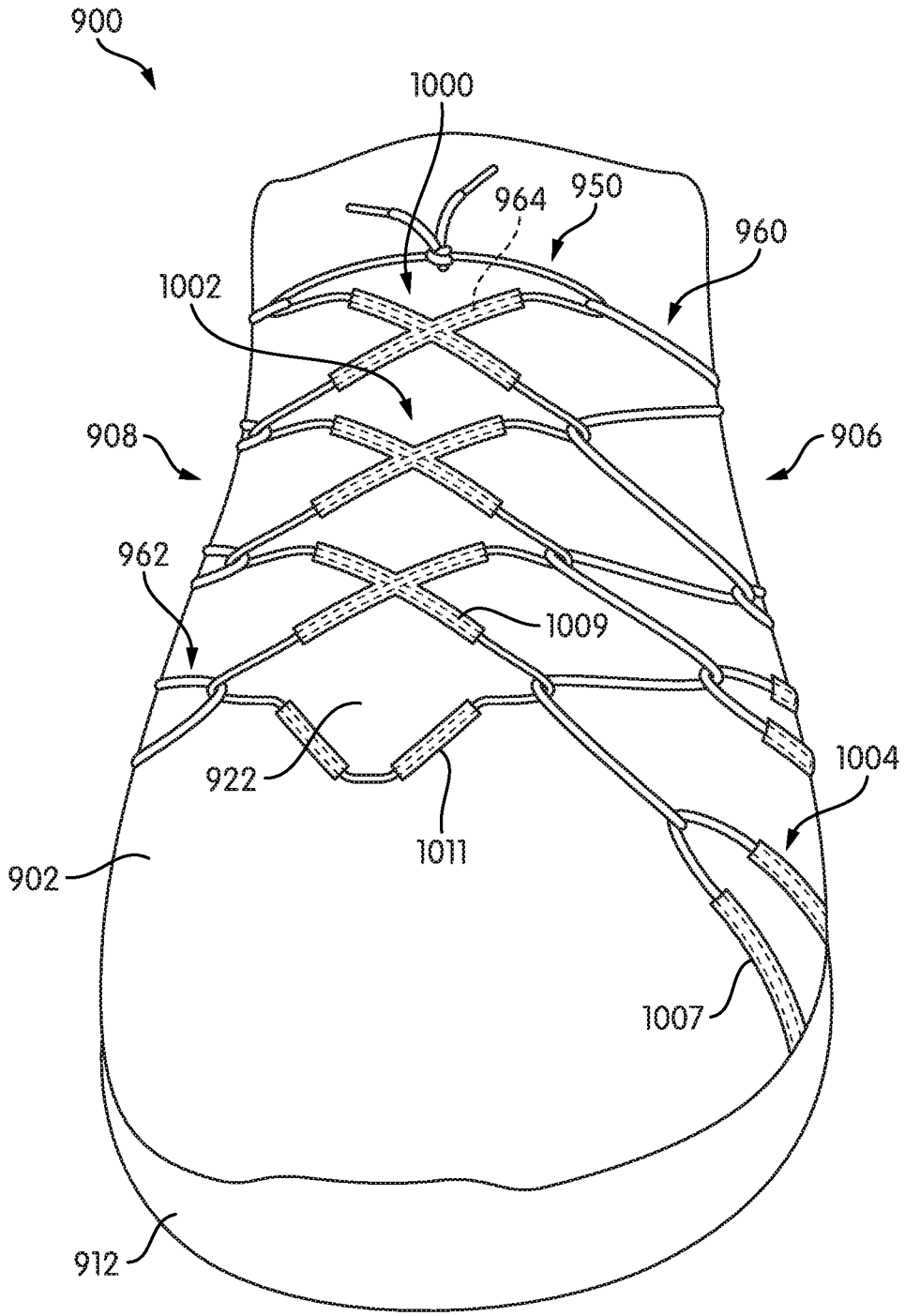
FIG. 27 is a front schematic view of the article of footwear of FIG. 26, in which portions of some cords are shown in phantom.

FIGS. 26 and 27 illustrate schematic front views of article 900. Referring now to FIGS. 24-27, some embodiments of article 900 may further include a plurality of channels 1000. Plurality of channels 1000 may comprise one or more individual channels that are arranged on various portions of article 900. For example, in some embodiments, plurality of channels 1000 may include a first channel group 1002 disposed on instep portion 922, a second channel group 1004 disposed on lateral side 906 and a third channel group 1006 disposed on medial side 908.

In some embodiments, each channel of plurality of channels 1000 may be configured to receive portions of one or more cords from plurality of cords 952 of mesh structure 950. Thus, in some embodiments, each channel may comprise a structure that is attached to either upper 902 or sole structure 912 such that cords passing through the channel are constrained in their orientations, positions and/or motions with respect to upper 902 and/or sole structure 912. In the exemplary embodiment, for example, each channel in plurality of channels 1000 may comprise a material element that is fixed along some of its edges to upper 902, thereby forming a channel, or tunnel, between the exterior surface of upper 902 and the interior surface of each channel. Thus, as shown in FIG. 27, central cord 964 may pass through first channel group 1002. In other embodiments, each channel may comprise a tube of material attached to article 900, so that a cord passing through a channel is surrounded by portions of the channel around the entire diameter of the cord.

Channels may be attached to article 900 in any way. In some embodiments, channels could be sewn or stitched to article 900. In other embodiments, channels could be formed simultaneously with article 900. For example, in some embodiments the channels could be knitted along with upper 902. In other embodiments any other provisions could be used, including adhesives or various welding methods, to join a channel to either upper 902 or sole structure 912 of article 900.

In different embodiments, the locations of one or more channels could vary. In the exemplary embodiment shown in FIGS. 24-27, first channel group 1002, may be disposed on instep portion 922 of article 900. Also, second channel group 1004 and third channel group 1006 may be disposed on lateral side 906 and medial side 908, respectively, of article 900. Thus, first channel group 1002 acts to receive and control central cord 964. Also, second channel group 1004 and third channel group 1006 act to receive and control first side cord group 962 and second side cord group 964. This particular arrangement for channels may help keep the cords of mesh structure 950 in a desired configuration, especially at instep portion 922 and along the sides of article 900. However, in other embodiments, one or more channels could be located in any other portions of article 900, including portions of upper 902 and/or of sole structure 912.

In different embodiments, the shape of a channel could vary. Exemplary channel shapes include, but are not limited to: linear channels (i.e., straight segments), Y-shaped, X-shaped channels, as well as any other kinds of channel shapes. In the exemplary embodiment, second channel group 1004 and third channel group 1006 comprise linear or straight channels 1007 that extend up from sole structure 912 on lateral side 906 and medial side 908, respectively. In addition, first channel group 1002 comprises several X-shaped channels 1009 that provide for the crossing of cord segments. First channel group 1002 also comprises two linear channels 1011 that receive central cord 964 at a forward most portion of instep portion 922.

In different embodiments, the number of channels could vary. For example, the exemplary embodiment includes three X-shaped channels as part of first channel group 1002. Also, first channel group 1002 includes two linear or straight channels. Further, second channel group 1004 and third channel group 1006 each include eight linear channels. Of course, other embodiments could include any other number of channels for each channel group.

Generally, the locations, geometry and number of channels used may be selected to achieve a desired positioning and alignment for one or more cords of mesh structure 950.

Although not illustrated in the embodiments of FIGS. 24-27, other embodiments could incorporate channels on a sole, including open channels such as those depicted in FIGS. 1-17, or closed channels such as those attached to upper 902 of the present embodiment. Moreover, it may be understood that other embodiments could utilize channels on upper 902 or sole structure 912 that are disposed on a lower side of upper 902 or an interior side of sole structure 912. Such channels may not be visible in the fully assembled article.

Although not visible in FIGS. 24-27, it should be understood that in at least some embodiments mesh structure 950 may wrap 360 degrees around upper 902, thereby providing 360 degree support for a foot inserted into article 900. More specifically, mesh structure 950 may include cords extending beneath an upper and foot in a similar manner to mesh structure 200 as depicted in FIG. 13-14.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. An article of footwear, comprising:

an upper having an upper interior surface and an upper exterior surface, the upper interior surface being disposed closer to an interior cavity of the upper than the upper exterior surface;

a sole structure having a sole interior surface and a sole exterior surface, the sole structure including a plurality of channels that extend through a bottom portion of the sole structure;

a mesh structure comprised of a plurality of cords, the mesh structure being wrapped around the article of footwear;

wherein a first portion of the mesh structure is in contact with a portion of the upper exterior surface; and wherein a second portion of the mesh structure is in contact with the sole exterior surface, the second portion of the mesh structure including a bottom section that is formed from a first subset of the plurality of cords and is in direct contact with the bottom portion of the sole structure, and a side section that is formed from a second subset of the plurality of cords and is in direct contact with a side wall portion of the sole structure, and wherein all of the first subset of the plurality of cords in bottom section of the second portion of the mesh structure is received, at least in part, in the plurality of channels that extend through the bottom portion of the sole structure, and at least one of the plurality of channels intersects at least one other channel of the plurality of channels at the bottom portion of the sole structure to thereby form at least one respective intersection, and wherein the at least one respective intersection is occupied by an intersection of at least two cords of the first subset of the plurality of cords in the bottom section of the second portion of the mesh structure.

2. The article of footwear according to claim 1, wherein the mesh structure is in contact with an instep portion of the upper, a toe portion of the upper, a lateral side portion of the upper, a medial side portion of the upper and a heel portion of the upper.

3. The article of footwear according to claim 1, wherein one or more of the plurality of channels extend through the side wall portion of the sole structure on the sole exterior surface.

4. The article of footwear according to claim 3, wherein the mesh structure extends from the side wall portion of the sole structure, through a peripheral portion of the sole structure and through the bottom portion of the sole structure.

5. The article of footwear according to claim 1, wherein the plurality of channels also extend through the side wall portion of the sole structure.

6. The article of footwear according to claim 1, wherein the mesh structure is detached from the upper.

7. The article of footwear according to claim 1, wherein the mesh structure includes a fastening region comprised of a fastening gap and a fastening cord and wherein applying tension to an end of the fastening cord decreases a width of the fastening gap and tightens the mesh structure around the article of footwear.

8. The article of footwear according to claim 1, wherein the plurality of cords includes a first cord having a first diameter and a second cord having a second diameter that is greater than the first diameter and wherein the first cord intersects the second cord within the mesh structure.

9. The article of footwear according to claim 8, wherein the second cord is inserted through an opening in the first cord.

10. An article of footwear, comprising:

an upper having an upper interior surface and an upper exterior surface, the upper interior surface being disposed closer to an interior cavity of the upper than the upper exterior surface;

a sole structure having a sole interior surface and a sole exterior surface that includes a plurality of channels, the plurality of channels extending through a bottom portion of the sole structure;

a mesh structure comprised of a plurality of cords, wherein the mesh structure is disposed so that a first section extends over the upper exterior surface and a second section is in contact with the sole exterior surface, the second section of the mesh structure including a bottom section that is formed from a first subset of the plurality of cords and is in direct contact with the bottom portion of the sole structure, and a side section that is formed from a second subset of the plurality of cords and is in direct contact with a side wall portion of the sole structure; and the mesh structure having a mesh periphery further including a first mesh periphery portion and a second mesh periphery portion;

the first mesh periphery portion and the second mesh periphery portion being separated by a first gap;

a first fastening cord engaging the first mesh periphery portion and the second mesh periphery portion such that when an end portion of the first fastening cord is pulled the first fastening cord pulls the first mesh periphery portion closer to the second mesh periphery portion, thereby tightening the mesh structure against the upper; and wherein all of the first subset of the plurality of cords in bottom section of the second section of the mesh structure is received, at least in part, in the plurality of channels that extend through the bottom portion of the sole structure, and at least one of the plurality of channels intersects at least one other channel of the plurality of channels at the bottom portion of the sole structure to thereby form at least one respective intersection, and wherein the at least one respective intersection is occupied by an intersection of at least two cords of the first subset of the plurality of cords in the bottom section of the second section of the mesh structure.

11. The article of footwear according to claim 10, wherein the first mesh periphery portion and the second mesh periphery portion extend approximately in a longitudinal direction of the article of footwear, the longitudinal direction extending from a forefoot portion of the article of footwear to a heel portion of the article of footwear.

12. The article of footwear according to claim 11, wherein the first mesh periphery portion and the second mesh periphery portion collectively form a U-shaped portion of the mesh periphery, the U-shaped portion being a shape with an open end, a curved end, and two sides extending from the curved end.

13. The article of footwear according to claim 10, wherein each of the first mesh periphery portion and the second mesh periphery portion include fastener receiving portions for receiving the first fastening cord.

14. The article of footwear according to claim 13, wherein the fastener receiving portions are loops formed from a cord of the plurality of cords.

15. The article of footwear according to claim 10, wherein the first gap is positioned in an asymmetric manner on the article of footwear.

16. The article of footwear according to claim 15, wherein the first gap is disposed on a medial side of the article of footwear.

17. The article of footwear according to claim 15, wherein the first gap is disposed on a lateral side of the article of footwear.

18. The article of footwear according to claim 10, wherein the mesh structure further comprises a second gap associated with a second fastening cord distinct from the first fastening cord.

19. The article of footwear according to claim 10, wherein at least one cord in the plurality of cords comprising the mesh structure has a first cord diameter and a first cord tensile strength; wherein the fastening cord has a second cord diameter and a second cord tensile strength that are the same as the first cord diameter and the first cord tensile strength, respectively.

* * * * *